US008746671B2

(12) United States Patent
Machida et al.

(10) Patent No.: US 8,746,671 B2
(45) Date of Patent: Jun. 10, 2014

(54) SHEET CONVEYING SYSTEM, COMPUTER PROGRAM PRODUCT, AND SHEET CONVEYING METHOD WITH SHEET INSERTING APPARATUS

(71) Applicants: Tatsushi Machida, Kanagawa (JP); Hitoshi Hattori, Tokyo (JP); Atsushi Kanaya, Kanagawa (JP); Yoshikatsu Tsuji, Ibaraki (JP); Ryo Kanno, Miyagi (JP)

(72) Inventors: Tatsushi Machida, Kanagawa (JP); Hitoshi Hattori, Tokyo (JP); Atsushi Kanaya, Kanagawa (JP); Yoshikatsu Tsuji, Ibaraki (JP); Ryo Kanno, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/737,267

(22) Filed: Jan. 9, 2013

(65) Prior Publication Data

US 2013/0175755 A1 Jul. 11, 2013

(30) Foreign Application Priority Data

Jan. 11, 2012 (JP) ..... 2012-003440

(51) Int. Cl.
*B65H 3/44* (2006.01)
*B65H 33/04* (2006.01)

(52) U.S. Cl.
CPC ..... *B65H 3/44* (2013.01); *B65H 33/04* (2013.01); *B65H 2301/4454* (2013.01)
USPC ..... 271/9.02; 271/9.13; 700/230; 270/58.31

(58) Field of Classification Search
CPC ... B65H 33/04; B65H 3/44; B65H 2301/4454
USPC ..... 271/9.13, 9.02, 9.04; 399/382; 270/58.31; 700/230
See application file for complete search history.

(56) References Cited

U.S. PATENT DOCUMENTS

| | | | | |
|---|---|---|---|---|
| 5,489,969 | A * | 2/1996 | Soler et al. | 399/383 |
| 5,839,045 | A * | 11/1998 | Wierszewski | 399/382 |
| 5,971,388 | A | 10/1999 | Hattori et al. | |
| 6,091,927 | A | 7/2000 | Hattori et al. | |
| 6,442,368 | B1 * | 8/2002 | Ohtsuka et al. | 399/382 |
| 7,711,448 | B2 * | 5/2010 | Fujii et al. | 271/296 |
| 7,828,278 | B2 * | 11/2010 | Tabuchi | 270/58.23 |
| 7,835,684 | B2 * | 11/2010 | Heimbach et al. | 399/394 |

(Continued)

FOREIGN PATENT DOCUMENTS

| | | |
|---|---|---|
| JP | 2002-308502 | 10/2002 |
| JP | 2005-070078 | 3/2005 |

(Continued)

*Primary Examiner* — Gerald McClain
(74) *Attorney, Agent, or Firm* — Oblon, Spivak, McClelland, Maier & Neustadt, L.L.P.

(57) ABSTRACT

A sheet conveying system includes a sheet inserting apparatus that inserts a second recording medium between first recording media conveyed by a sheet conveying apparatus, and transmits a first time at which second recording media can be successively received hypothetically, and a second time indicating a difference between a conveying time from an accumulating unit of a second recording medium to a merging point at which a second recording medium is inserted and a conveying time from a sheet receiving surface of the sheet inserting apparatus to the merging point. The sheet conveying apparatus sets longer one of the received first time and second time as an insertion interval; and conveys first recording media such that an interval extended by an added value obtained by adding a conveying time corresponding to a length of second recording medium to the insertion interval is provided between the first recording media.

8 Claims, 10 Drawing Sheets

(56) References Cited

U.S. PATENT DOCUMENTS

| | | | | |
|---|---|---|---|---|
| 7,878,497 | B2 * | 2/2011 | Adachi | 270/58.23 |
| 7,905,478 | B2 * | 3/2011 | Tabuchi | 270/58.31 |
| 7,991,345 | B2 * | 8/2011 | Yamamoto | 399/382 |
| 2004/0004319 | A1 | 1/2004 | Hattori et al. | |
| 2004/0126163 | A1 | 7/2004 | Asami et al. | |
| 2005/0000336 | A1 | 1/2005 | Hattori et al. | |
| 2005/0042007 | A1 | 2/2005 | Fujii et al. | |
| 2006/0261544 | A1 | 11/2006 | Tamura et al. | |
| 2007/0012676 | A1 | 1/2007 | Koide et al. | |
| 2007/0040328 | A1 | 2/2007 | Hattori | |
| 2007/0107577 | A1 | 5/2007 | Hattori et al. | |
| 2007/0182082 | A1 | 8/2007 | Asami et al. | |
| 2007/0235917 | A1 | 10/2007 | Nagasako et al. | |
| 2008/0006993 | A1 | 1/2008 | Nomura et al. | |
| 2008/0048380 | A1 | 2/2008 | Ichihashi et al. | |
| 2008/0067730 | A1 | 3/2008 | Suzuki et al. | |
| 2008/0068657 | A1 | 3/2008 | Uchida et al. | |
| 2008/0099974 | A1 | 5/2008 | Nomura et al. | |
| 2008/0179809 | A1 | 7/2008 | Kikkawa et al. | |
| 2008/0217837 | A1 | 9/2008 | Nagasako et al. | |
| 2008/0224386 | A1 | 9/2008 | Kunieda et al. | |
| 2008/0236351 | A1 | 10/2008 | Hidaka et al. | |
| 2008/0290830 | A1 | 11/2008 | Hattori et al. | |
| 2008/0292347 | A1 | 11/2008 | Koide et al. | |
| 2009/0014939 | A1 | 1/2009 | Ichihashi et al. | |
| 2009/0014949 | A1 | 1/2009 | Ichihashi et al. | |
| 2009/0039593 | A1 | 2/2009 | Kikkawa et al. | |
| 2009/0051100 | A1 | 2/2009 | Hattori et al. | |
| 2009/0057978 | A1 | 3/2009 | Maeda et al. | |
| 2009/0060604 | A1 | 3/2009 | Hattori et al. | |
| 2009/0066001 | A1 | 3/2009 | Ichihashi et al. | |
| 2009/0066003 | A1 | 3/2009 | Kunieda et al. | |
| 2009/0137374 | A1 | 5/2009 | Kobayashi et al. | |
| 2009/0152789 | A1 | 6/2009 | Kikkawa et al. | |
| 2009/0200725 | A1 | 8/2009 | Tamura et al. | |
| 2009/0206540 | A1 * | 8/2009 | Adachi | 271/9.13 |
| 2009/0206547 | A1 | 8/2009 | Tokita et al. | |
| 2009/0258774 | A1 | 10/2009 | Suzuki et al. | |
| 2009/0283961 | A1 | 11/2009 | Saito et al. | |
| 2010/0027081 | A1 | 2/2010 | Sano et al. | |
| 2010/0148417 | A1 | 6/2010 | Suzuki et al. | |
| 2010/0207314 | A1 | 8/2010 | Hattori et al. | |
| 2010/0225045 | A1 | 9/2010 | Kimura et al. | |
| 2011/0018189 | A1 * | 1/2011 | Tabuchi | 270/58.31 |
| 2011/0076081 | A1 | 3/2011 | Hattori et al. | |
| 2011/0130260 | A1 | 6/2011 | Kikkawa et al. | |
| 2011/0245055 | A1 | 10/2011 | Saito et al. | |
| 2011/0301005 | A1 | 12/2011 | Hattori et al. | |
| 2011/0301008 | A1 | 12/2011 | Shibasaki et al. | |
| 2011/0301011 | A1 | 12/2011 | Ishikawa et al. | |
| 2011/0304092 | A1 | 12/2011 | Kambayashi et al. | |
| 2012/0057212 | A1 | 3/2012 | Tobinaga et al. | |
| 2012/0083400 | A1 | 4/2012 | Shibasaki et al. | |
| 2012/0086161 | A1 | 4/2012 | Nagasako et al. | |
| 2012/0115702 | A1 | 5/2012 | Ishikawa et al. | |
| 2012/0119432 | A1 | 5/2012 | Kambayashi et al. | |
| 2012/0119436 | A1 | 5/2012 | Morita et al. | |
| 2012/0147388 | A1 | 6/2012 | Kojima et al. | |
| 2012/0157285 | A1 | 6/2012 | Aiba et al. | |
| 2012/0314267 | A1 | 12/2012 | Suzuki et al. | |

FOREIGN PATENT DOCUMENTS

| | | | | |
|---|---|---|---|---|
| JP | 2005070078 A * | 3/2005 | | G03G 21/14 |
| JP | 2008-127170 | 6/2008 | | |
| JP | 2008127170 A * | 6/2008 | | |

* cited by examiner

SHEET CONVEYING SYSTEM, COMPUTER PROGRAM PRODUCT, AND SHEET CONVEYING METHOD WITH SHEET INSERTING APPARATUS

CROSS-REFERENCE TO RELATED APPLICATIONS

The present application claims priority to and incorporates by reference the entire contents of Japanese Patent Application No. 2012-003440 filed in Japan on Jan. 11, 2012.

BACKGROUND OF THE INVENTION

1. Field of the Invention

The present invention relates to a sheet conveying system, a sheet conveying program, and a sheet conveying method.

2. Description of the Related Art

Conventionally known are apparatuses such as image forming apparatuses, sorting apparatuses, and folding apparatuses provided with a sheet conveying mechanism. Furthermore, generally practiced is installing a plurality of such apparatuses in series to allow sheets to be conveyed sequentially across these apparatuses. In addition, known is a system provided with, between such apparatuses, a sheet inserting apparatus that inserts a new sheet between sheets conveyed from an upstream apparatus (for example, see Japanese Patent Application Laid-open No. 2008-127170 and Japanese Patent Application Laid-open No. 2005-070078).

Japanese Patent Application Laid-open No. 2008-127170 discloses a structure in which timing information to insert an insert between sheets is read from the insert on which the timing information is recorded, and the insert is inserted based on the read timing information. Japanese Patent Application Laid-open No. 2005-070078 discloses that an inserter apparatus installed downstream of an image forming apparatus is caused to start an insert feeding process when an insert feed command is received from the image forming apparatus installed upstream. Japanese Patent Application Laid-open No. 2005-070078 also discloses that, when the insert feeding process is started, the inserter apparatus notifies a post-processing apparatus installed downstream of the inserter apparatus, of a command indicating that the insert has passed through an exit of the inserter apparatus.

However, in the conventional technologies, when the configuration of the sheet inserting apparatus that inserts a sheet is changed, the timing adjustment in accordance with the changed configuration needs to be performed anew. Therefore, when the configuration of the sheet inserting apparatus is changed, a computer program for the apparatus arranged upstream of the sheet inserting apparatus needs to be changed accordingly. Therefore, versatility has been desired.

There is a need to provide a sheet conveying system, a sheet conveying program, and a sheet conveying method that are versatile.

SUMMARY OF THE INVENTION

It is an object of the present invention to at least partially solve the problems in the conventional technology.

A sheet conveying system includes: a sheet conveying apparatus that sequentially conveys a plurality of first recording media; and a sheet inserting apparatus that is provided downstream of the sheet conveying apparatus in a conveying direction of first recording media, and inserts a second recording medium between first recording media. The sheet inserting apparatus comprises: a first transmitting unit that transmits, to the sheet conveying apparatus, a first time indicating a receiving interval at which second recording media can be successively received hypothetically from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point. The sheet conveying apparatus includes: a first conveying unit that conveys first recording media at a first interval; a first receiving unit that receives the first time and the second time; a setting unit that sets longer one of the first time and the second time as an insertion interval to insert a second recording medium; and a first conveying controlling unit that controls the first conveying unit to convey first recording media such that an interval extended by a second interval corresponding to an added value obtained by adding a conveying time corresponding to a length of second recording medium in the conveying direction to the insertion interval is provided between the first recording media.

A computer program product includes a non-transitory computer-usable medium having computer-readable program codes embodied in the medium. The computer-readable program codes is of a sheet conveying program to be executed by a computer controlling a sheet conveying apparatus that is provided upstream of a sheet inserting apparatus in a conveying direction and sequentially conveys a plurality of first recording media. The sheet inserting apparatus inserts a second recording medium between first recording media. The program codes when executed causes the computer to execute: first receiving a first time indicating a receiving interval at which second recording media can be successively received hypothetically from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point; setting longer one of the first time and the second time as an insertion interval to insert a second recording medium; and performing first conveying control to convey first recording media such that an interval extended by a second interval corresponding to an added value obtained by adding a conveying time corresponding to a length of the second recording medium in the conveying direction to the insertion interval is provided between the first recording media.

A sheet conveying method is executed by a sheet conveying apparatus that is provided upstream of a sheet inserting apparatus in a conveying direction and sequentially conveys a plurality of first recording media. The sheet inserting apparatus inserts a second recording medium between first recording media. The sheet conveying method includes: first receiving a first time indicating a receiving interval at which second recording media can be successively received hypothetically from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point; setting longer one of the first time and the second time as an insertion interval to insert the second recording medium; and performing first conveying control to convey first recording media such that an interval extended by a second interval corresponding to an added value obtained by adding a conveying time corresponding to a length of the second recording medium in the conveying direction to the insertion interval is provided between the first recording media.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a sheet conveying system, a sheet conveying program, and a sheet conveying method will now be explained in detail with reference to the appended drawings.

Figure 1:
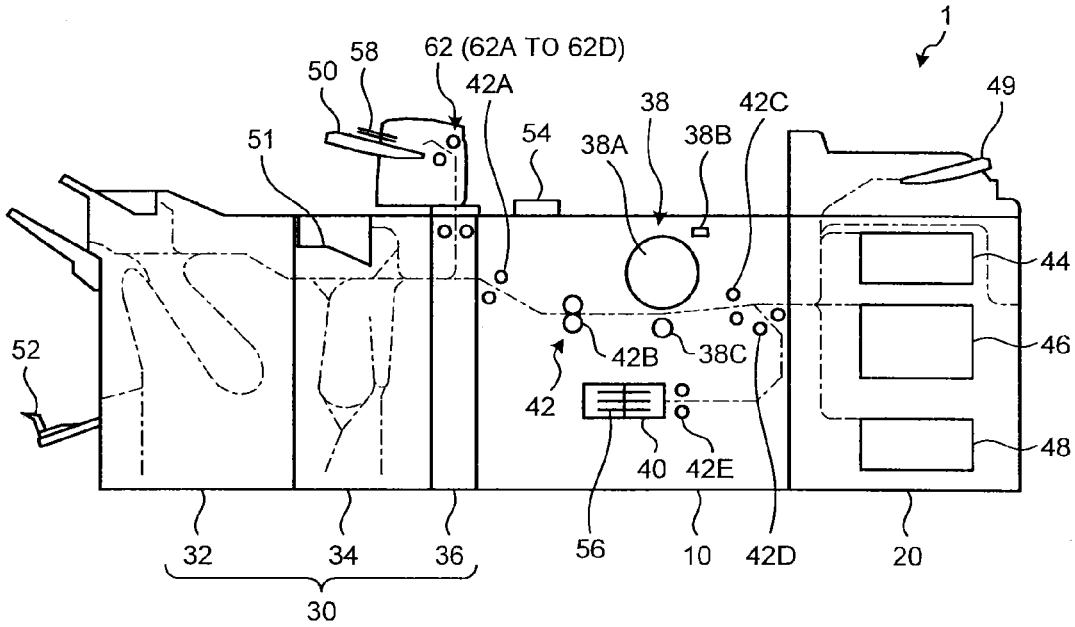
FIG. 1 is a schematic illustrating a sheet conveying system according to an embodiment of the present invention.

FIG. 1 is a schematic illustrating a sheet conveying system 1 according to the embodiment. The sheet conveying system 1 according to the embodiment includes a sheet conveying apparatus 10, a feeding apparatus 20, and post-processing apparatuses 30. The post-processing apparatuses 30 include a sheet inserting apparatus 36, a post-processing apparatus 34, and a post-processing apparatus 32.

The feeding apparatus 20 is an apparatus that feeds first sheets 56 into the sheet conveying apparatus 10. The feeding apparatus 20 includes a tray 44, a tray 46, a tray 48, and a manual bypass tray 49 in which the first sheets 56 are stored. The feeding apparatus 20 includes a conveying mechanism not illustrated. When the feeding apparatus 20 receives a feeding request signal from the sheet conveying apparatus 10, the feeding apparatus 20 conveys the first sheet 56 from one of the tray 44, the tray 46, the tray 48, and the manual bypass tray 49 into the sheet conveying apparatus 10, one sheet at a time. The sheet conveying system 1 may also include a plurality of the feeding apparatuses 20. As mentioned earlier, the sheet conveying system 1 may have a configuration that does not include the feeding apparatus 20.

The sheet conveying apparatus 10 is provided downstream of the feeding apparatus 20 in a conveying direction. The sheet conveying apparatus 10 conveys the first sheet 56. The sheet conveying apparatus 10 adjusts an insertion interval at which a second sheet 58 is inserted by the sheet inserting apparatus 36 described later (details will be explained later).

A known recording medium is used as the first sheet 56 and the second sheet 58. The first sheet 56 and the second sheet 58 may be the same type of recording media, or different types of recording media.

Explained in the embodiment is an example in which the sheet conveying apparatus 10 conveys a plurality of first sheets 56 sequentially to the post-processing apparatuses 30, and functions as an image forming apparatus that forms an image on the first sheet 56. The sheet conveying apparatus 10 may have any configuration as long as it includes a conveying mechanism that conveys the first sheet 56, and the sheet conveying apparatus 10 is not limited to an image forming apparatus.

The sheet conveying apparatus 10 includes a tray 40, conveying units 42, an image forming unit 38, and a display unit 54. The tray 40 stores therein the first sheets 56. The tray 40 has a smaller capacity than the trays 44 to 48 provided in the feeding apparatus 20. The conveying units 42 are a conveying mechanism that conveys the first sheet 56 stored in the tray 40, or the first sheet 56 conveyed from the feeding apparatus 20. The conveying units 42 include conveying units 42A to 42E. Each of the conveying units 42 includes members such as a conveying roller, and is driven under the control of a conveying controlling unit that is described later.

The display unit 54 receives inputs of various types of information from a user, and displays various types of information. The display unit 54 is a touch panel, for example. The display unit 54 may also have a configuration including various operation keys such as a numeric keypad, a start key, a function key, and a one-touch key, and a display device such as a liquid crystal display.

The image forming unit 38 forms an image on the first sheet 56 conveyed by the conveying units 42. Examples of the image forming unit 38 include an electrophotographic image forming unit and an inkjet image forming unit. When the image forming unit 38 is an electrophotographic image forming unit, the image forming unit 38 includes a photosensitive element 38A, an exposing unit 38B, and a transfer unit 38C. The exposing unit 38B irradiates the photosensitive element 38A charged by a charging unit not illustrated with light modulated according to image data of an image to be formed. In this manner, the photosensitive element 38A is scan-exposed and an electrostatic latent image corresponding to the image to be formed is formed on the photosensitive element 38A. The electrostatic latent image is developed into a toner image by a developing unit not illustrated. When the toner image on the photosensitive element 38A reaches the position of the transfer unit 38C as the photosensitive element 38A is rotated, the toner image is transferred onto the first sheet 56 fed between the photosensitive element 38A and the transfer unit 38C. The toner image transferred on the first sheet 56 is fixed by a fixing unit not illustrated, and the image is formed on the first sheet 56.

The first sheet 56 on which the image is formed by the image forming unit 38 is conveyed by the conveying units 42 (the conveying unit 42B and the conveying unit 42A), and discharged from the sheet conveying apparatus 10.

The post-processing apparatus 34, and the post-processing apparatus 32 are provided in the post-processing apparatuses 30 sequentially from upstream in the conveying direction.

The sheet inserting apparatus 36 receives the first sheets 56 conveyed by the sheet conveying apparatus 10 sequentially, inserts a second sheet 58 with one or more first sheets 56 on each side of the second sheet 58, and conveys these sheets. Examples of the second sheet 58 include a cover sheet printed for binding and a divider sheet that does not require any image formation.

Explained in the embodiment is an example in which the sheet conveying system 1 includes the single sheet inserting apparatus 36. Alternatively, the sheet conveying system 1 may include a plurality of the sheet conveying apparatus 36.

The post-processing apparatus 34 and the post-processing apparatus 32 are apparatuses for applying post-processes to the first sheet 56 and the second sheet 58 conveyed from the sheet conveying apparatus 10 and the sheet inserting apparatus 36. Examples of the post-processes include a folding process of folding the sheet in a Z-shape or double-folding the sheet, a binding process of performing ring-binding or case binding, a sorting process, a cutting process, a punching process of punching a hole, and a stapling process, but are not limited thereto. In the embodiment, the post-processing apparatus 34 includes an accumulating unit (not illustrated) in which the first sheet 56 and the second sheet 58 discharged from the sheet conveying apparatus 10 are temporarily accumulated. Once a predetermined number of the first sheet 56 and the second sheet 58 are accumulated, the post-processing apparatus 34 sequentially conveys the first sheet 56 and the second sheet 58 into the post-processing apparatus 32.

The post-processing apparatus 32 performs a stapling process or a punching process. The post-processing apparatus 32 includes a discharge tray 52 on which the first sheet 56 and the second sheet 58 are discharged. The post-processing apparatus 32 discharges the first sheet 56 and the second sheet 58 subjected to the stapling process or the punching process to the discharge tray 52. In the stapling process, waste staples are produced as a result of cutting staples depending on the number of sheets (the first sheet 56 and the second sheet 58) that are bounded. In addition, in the punching process, punching waste is produced when holes are punched on the sheets (the first sheet 56 and the second sheet 58). Therefore, the post-processing apparatus 32 includes waste collecting units (none of which is illustrated) to store waste such as the waste staples and the punching waste.

The sheet conveying system 1 may have any configuration as long as it includes at least the sheet conveying apparatus 10 and the sheet inserting apparatus 36. The sheet inserting apparatus 36 may be installed at any position downstream of the sheet conveying apparatus 10 in the conveying direction, and the arrangement is not limited to that in which the sheet inserting apparatus 36 is installed adjacent to and downstream of the sheet conveying apparatus 10 in the conveying direction.

Figure 2:
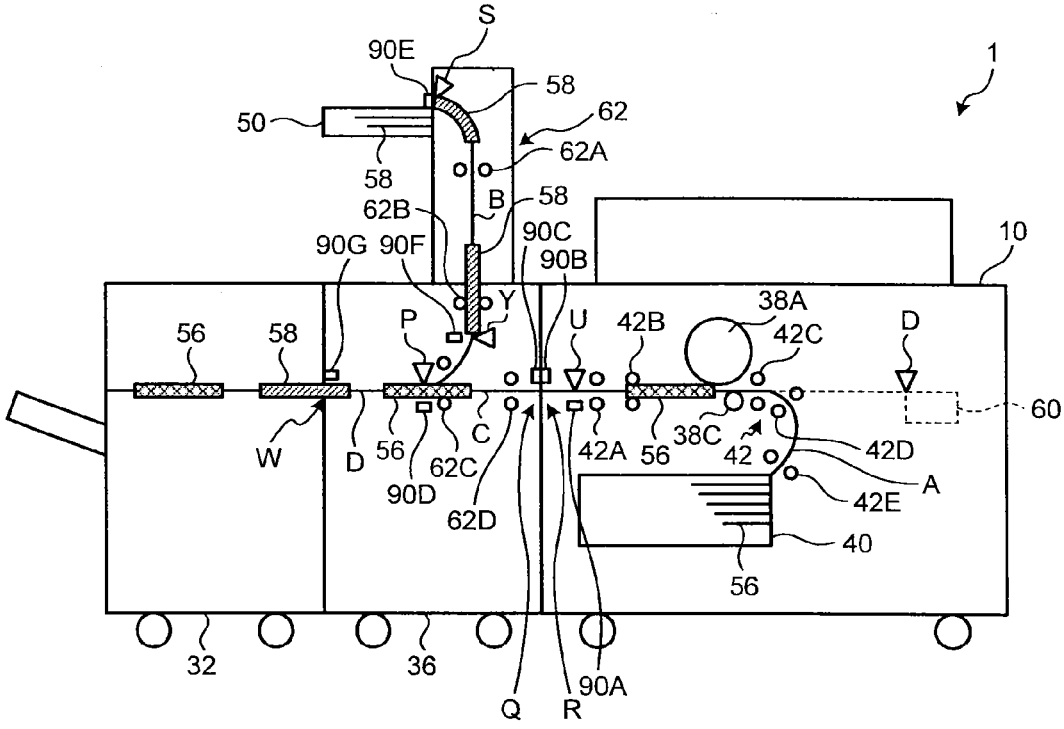
FIG. 2 is a schematic illustrating a sheet conveying apparatus and a sheet inserting apparatus more in detail.

The sheet conveying apparatus 10 and the sheet inserting apparatus 36 will now be explained more in detail. FIG. 2 is a schematic illustrating the sheet conveying apparatus 10 and the sheet inserting apparatus 36 more in detail.

The conveying unit 42E, the conveying unit 42D, and the conveying unit 42C included in the sheet conveying apparatus 10 convey the first sheet 56 accumulated in the tray 40 along a conveying path A. Thereby, the first sheet 56 reaches an area where the photosensitive element 38A and the transfer unit 38C face each other. In the facing area, an image is transferred onto the first sheet 56. The image is then fixed by a fixing unit not illustrated. In this manner, an image is formed on the first sheet 56.

The conveying unit 42B and the conveying unit 42A convey the first sheet 56 on which the image is formed to a sheet discharge surface R along the conveying path A and discharges the first sheet 56 outside of the sheet conveying apparatus 10, that is, into the sheet inserting apparatus 36. The sheet discharge surface R is an end surface of the sheet conveying apparatus 10 from which the first sheet 56 is discharged. A sensor 90B to detect the first sheet 56 is provided on the discharge surface R.

An insertion request transmitting position U is set in the conveying path A, downstream of the photosensitive element 38A in the conveying direction and upstream of the sheet discharge surface R in the conveying direction. The insertion request transmitting position U is to cause the sheet conveying apparatus 10 to transmit a request to insert a second sheet 58 to the sheet inserting apparatus 36. A sensor 90A to detect the first sheet 56 is provided at the insertion request transmitting position U.

In the sheet conveying apparatus 10, the assumption that the first sheets 56 are conveyed with a second sheet 58 inserted between the first sheets 56 is made. At the position where the second sheet 58 is to be inserted, the sheet conveying apparatus 10 conveys the first sheets 56 so that an interval corresponding to the length of the second sheet 58 plus the insertion interval of the second sheet 58 is provided between the conveyed first sheets 56 where the second sheet 58 is to be inserted. To adjust the interval, the sheet conveying apparatus 10 adjusts the timing at which the first sheets 56 are conveyed on the assumption that a virtually conveyed sheet corresponding to the second sheet 58 is accumulated in a virtual tray 60.

The sheet inserting apparatus 36 includes a tray 50 storing therein the second sheets 58, and conveying units 62. The conveying units 62 include a plurality of conveying units 62A to 62D. The sheet inserting apparatus 36 has a conveying path C to convey the first sheet 56, a conveying path B to convey the second sheet 58, and a conveying path D to convey the first sheet 56 and the second sheet 58.

The conveying path C is to convey the first sheet 56 conveyed from the sheet conveying apparatus 10, from a sheet receiving surface Q to a merging point P. The conveying unit 62D is provided along the conveying path C, and conveys the first sheet 56 from the sheet receiving surface Q to the merging point P.

The sheet receiving surface Q is an end surface of the sheet inserting apparatus 36 from which the first sheet 56 is inserted. A sensor 90C to detect the first sheet 56 is provided on the sheet receiving surface Q. The merging point P is a point at which the conveying path C, the conveying path B, and the conveying path D merge. The merging point P is where the second sheet 58 conveyed from the conveying path B is inserted between the first sheets 56 conveyed from the conveying path C. A sheet discharge surface W is an end surface of the sheet inserting apparatus 36 from which a recording medium such as the first sheet 56 and the second sheet 58 is discharged. A sensor 90G to detect a recording medium such as the first sheet 56 and the second sheet 58 is provided on the sheet discharge surface W.

The conveying path B is to convey the second sheet 58 accumulated in the tray 50 from a discharge position S, from which the second sheet 58 is discharged from the tray 50 to the conveying path B, to the merging point P via an insertion standby position Y. The conveying unit 62A and the conveying unit 62B are provided along the conveying path B, and convey the second sheet 58 accumulated in the tray 50 from the discharge position S to the merging point P via the insertion standby position Y.

The conveying path D is to convey the first sheet 56 and the second sheet 58 from the merging point P to the sheet discharge surface W. The conveying unit 62C is provided along the conveying path D, and conveys the first sheet 56 and the second sheet 58 along the conveying path D.

A function of each of the units included in each of the apparatuses in the sheet conveying system 1 will now be explained.

Figure 3:
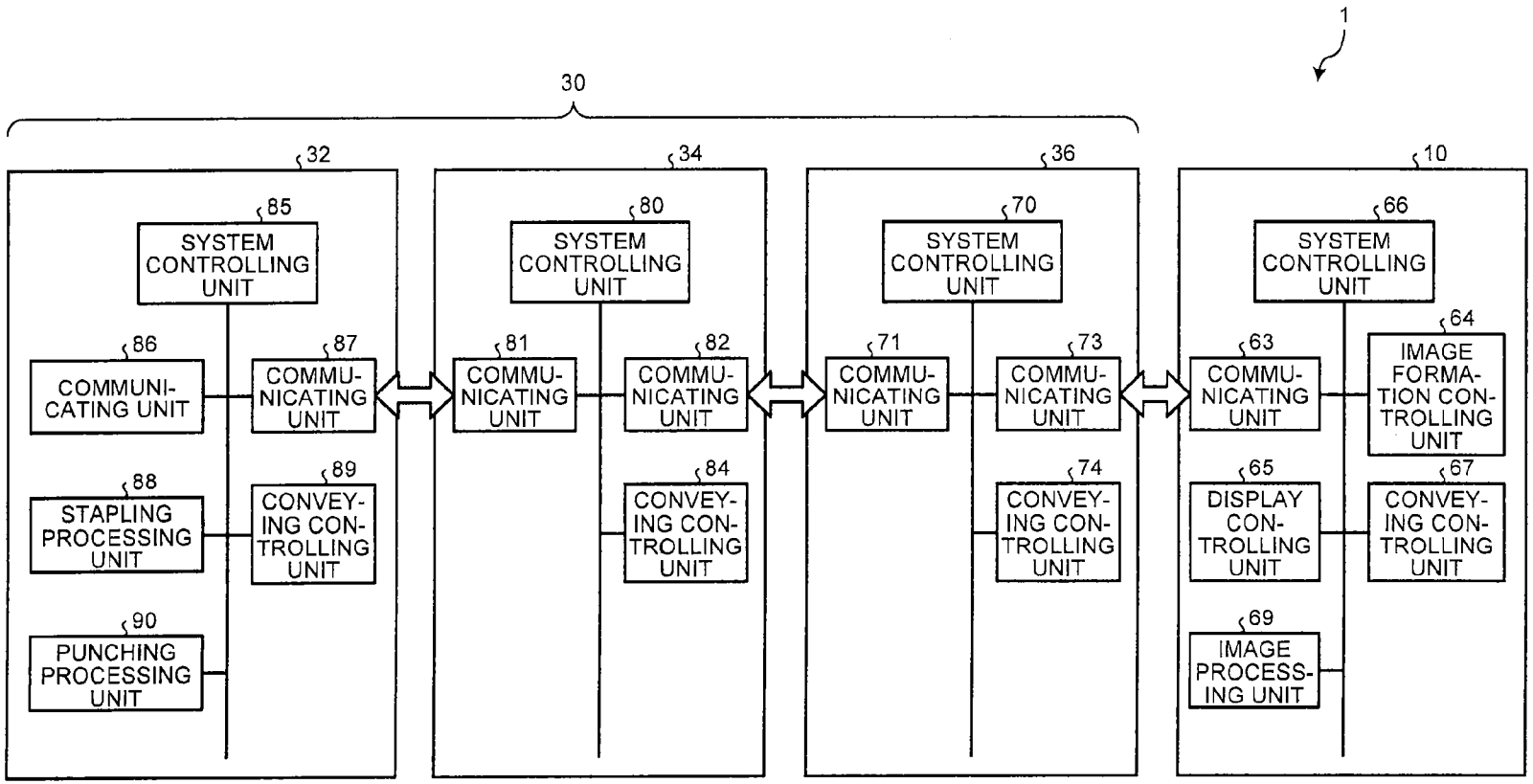
FIG. 3 is a functional block diagram of the sheet conveying apparatus, the sheet inserting apparatus, a post-processing apparatus, and another post-processing apparatus.

FIG. 3 is a block diagram of the sheet conveying apparatus 10, the sheet inserting apparatus 36, the post-processing apparatus 34, and the post-processing apparatus 32 in the sheet conveying system 1.

The sheet conveying apparatus 10 includes a system controlling unit 66, an image formation controlling unit 64, a conveying controlling unit 67, a communicating unit 63, a display controlling unit 65, and an image processing unit 69.

The system controlling unit 66 controls the entire sheet conveying apparatus 10. The system controlling unit 66 is a computer including a central processing unit (CPU), a read-only memory (ROM), and a random access memory (RAM).

The image processing unit 69 generates image data that can be handled by the sheet conveying apparatus 10, from print data received from an external apparatus, or from image data of an image scanned by a scanner function unit not illustrated included in the sheet conveying apparatus 10. The image formation controlling unit 64 transmits a signal modulated according to the image data generated by the image processing unit 69 to the exposing unit 38B. Thereby, the exposing unit 38B forms an electrostatic latent image corresponding to the image to be formed, on the photosensitive element 38A.

The conveying controlling unit 67 controls driving of the conveying units 42 (the conveying unit 42A to the conveying unit 42E) provided in the sheet conveying apparatus 10. The communicating unit 63 is a communication port through which data is transmitted and received to and from the sheet inserting apparatus 36, and transmits and receives data to and from the sheet inserting apparatus 36 over a communication cable or the like.

The sheet inserting apparatus 36 includes a system controlling unit 70, a communicating unit 71, a communicating unit 73, and a conveying controlling unit 74. The system controlling unit 70 controls the entire sheet inserting apparatus 36. The system controlling unit 70 is a computer including a CPU, a ROM, and a RAM.

The communicating unit 73 is a communication port through which data is transmitted to and received from the sheet conveying apparatus 10, and transmits and receives data to and from the sheet conveying apparatus 10 over a communication cable or the like. The communicating unit 71 is a communication port through which data is transmitted to and received from the post-processing apparatus 34, and transmits and receives data to and from the post-processing apparatus 34 over a communication cable or the like. The conveying controlling unit 74 controls driving of the conveying units 62 (the conveying unit 62A to the conveying unit 62D) provided in the sheet inserting apparatus 36.

The post-processing apparatus 34 includes a system controlling unit 80, a communicating unit 81, a communicating unit 82, and a conveying controlling unit 84. The system controlling unit 80 controls the entire post-processing apparatus 34. The system controlling unit 80 is a computer including a CPU, a ROM, and a RAM.

The communicating unit 82 is a communication port through which data is transmitted to and received from the sheet inserting apparatus 36, and transmits and receives data to and from the sheet inserting apparatus 36 over a communication cable or the like. The communicating unit 81 is a communication port through which data is transmitted to and received from the post-processing apparatus 32, and transmits and receives data to and from the post-processing apparatus 32 over a communication cable or the like. The conveying controlling unit 84 controls driving of conveying units (not illustrated) provided in the post-processing apparatus 34.

The post-processing apparatus 32 includes a system controlling unit 85, a communicating unit 87, a communicating unit 86, a conveying controlling unit 89, a stapling processing unit 88, and a punching processing unit 90. The system controlling unit 85 controls the entire post-processing apparatus 32. The system controlling unit 85 is a computer including a CPU, a ROM, and a RAM.

The communicating unit 87 is a communication port through which data is transmitted to and received from the post-processing apparatus 34, and transmits and receives data to and from the post-processing apparatus 34 over a communication cable or the like. The communicating unit 86 is a communication port through which data is transmitted to and received from an external apparatus. The conveying controlling unit 89 controls driving of conveying units (not illustrated) provided in the post-processing apparatus 32. The stapling processing unit 88 controls driving of a processing unit (not illustrated) performing a stapling process and provided in the post-processing apparatus 32. The punching processing unit 90 controls driving of a processing unit (not illustrated) performing a punching process and provided in the post-processing apparatus 32.

Figure 4:
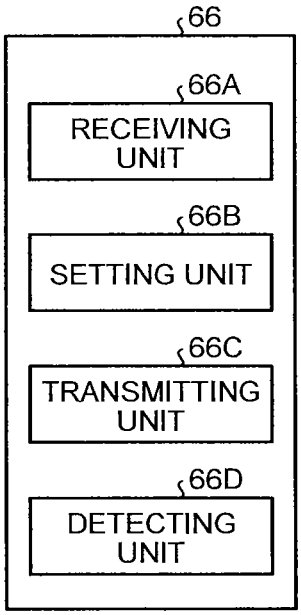
FIG. 4 is a functional block diagram of a system controlling unit.

The system controlling unit 66 included in the sheet conveying apparatus 10 will now be explained more in detail. FIG. 4 is a functional block diagram of the system controlling unit 66.

As illustrated in FIG. 4, the system controlling unit 66 in the sheet conveying apparatus 10 includes a receiving unit 66A, a setting unit 66B, a transmitting unit 66C, and a detecting unit 66D.

The receiving unit 66A (first receiving unit) receives information indicating a first time and a second time from the sheet inserting apparatus 36.

The first time indicates a reception interval at which the second sheet 58 can be received by each of the post-processing apparatuses 30 (the post-processing apparatus 32, the post-processing apparatus 34, the sheet inserting apparatus 36). Specifically, the first time indicates a reception interval at which the second sheet 58 can be received, hypothetically assuming that the sheet inserting apparatus 36 receives the second sheets 58 successively from the sheet conveying apparatus 10. The first time may indicate a reception interval at which the second sheet 58 can be received at least in the case where the sheet inserting apparatus 36 successively receives the second sheets 58. When the post-processing apparatuses 30 includes a plurality of post-processing apparatuses including the post-processing apparatus 32, the post-processing apparatus 34, and the sheet inserting apparatus 36 as described above, the first time is set to the longest one of the reception intervals at which the second sheet 58 can be received by the respective apparatuses included in the post-processing apparatuses 30.

The receiving unit 66A receives sheet interval information, indicating a reception interval of the first sheet 56, from the sheet inserting apparatus 36. The sheet interval information may indicate a time indicating a reception interval at which the first sheet 56 can be received at least in the case where the sheet inserting apparatus 36 receives the first sheet 56. Preferably, the sheet interval information of the first sheet 56 indicates the longest one of the reception intervals at which the first sheet 56 can be received by the respective apparatuses included in the post-processing apparatuses 30.

In the explanations below, the first time of the second sheet 58 and the sheet interval information of the first sheet 56 will be sometimes simply referred to as sheet interval information, when these pieces of information are explained collectively. When the first time of the second sheet 58 is to be explained distinctively, such a first time will be referred to as sheet interval information being the first time of the second sheet 58. Similarly, when the sheet interval information of the first sheet 56 is to be explained distinctively, such sheet interval information will be referred to as sheet interval information of the first sheet 56.

The second time indicates an insertion preparation time of the second sheet 58 in the sheet inserting apparatus 36.

Figure 5:
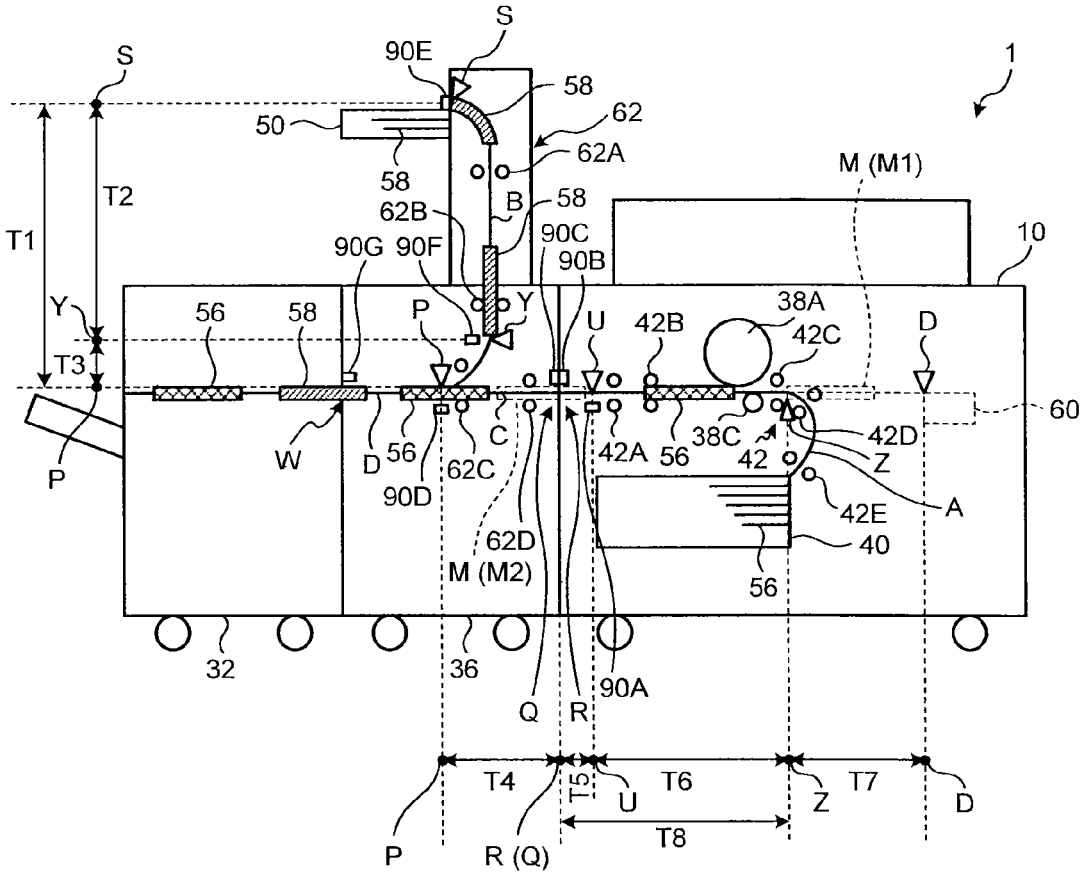
FIG. 5 is a schematic illustrating conveyance of a sheet in the sheet conveying apparatus.

FIG. 5 is a schematic illustrating how the first sheet 56 is conveyed in the sheet conveying apparatus 10. As illustrated in FIG. 5, the second time indicates a difference between a time for conveying a second sheet 58 from the discharge position S of the tray 50 accumulating therein the second sheet 58 to the merging point P (see a time T1 in FIG. 5) and a time for conveying the second sheet 58 from the sheet receiving surface Q to the merging point P (a time T4).

In the explanations below, the second time will be referred to as the insertion preparation time.

Referring back to FIG. 4, the setting unit 66B sets the time of longer one of the sheet interval information being the first time of the second sheet 58 and the insertion preparation time received by the receiving unit 66A as an insertion interval to insert the second sheet 58.

The conveying controlling unit 67 (see FIG. 3) included in the sheet conveying apparatus 10 controls the conveying units 42 to convey the first sheets 56 such that an interval that is based on the sheet interval information of the first sheet 56 is provided between the first sheets. As a result, the first sheets 56 are sequentially conveyed at that interval.

The conveying controlling unit 67 included in the sheet conveying apparatus 10 controls the conveying units 42 to convey the first sheets 56 such that an interval extended by an interval corresponding to an added value obtained by adding a conveying time corresponding to the length of the second sheet 58 in the conveying direction to the set insertion interval is provided between the first sheets 56 at the position where the second sheet 58 is to be inserted. Thereby, the first sheets 56 are conveyed such that an interval obtained by adding an interval corresponding to the sheet interval information of the first sheet 56 to the interval corresponding to the added value is provided between the sheets 56 at the position where the second sheet 58 is to be inserted.

Specifically, as illustrated in FIG. 5, the conveying controlling unit 67 conveys the first sheets 56 such that an interval is provided between the first sheets 56 by assuming that the virtual tray 60 is present at a position corresponding to longer one of the sheet interval information being the first time of the second sheet 58 and the insertion preparation time received from the sheet inserting apparatus 36 by the receiving unit 66A. More specifically, the conveying controlling unit 67 controls conveying timing by assuming that the virtual tray 60 is present at a position away from the sheet discharge surface R by a distance corresponding to a conveying time from the virtual tray 60 to the sheet receiving surface Q (an added value obtained by adding a time T5, a time T6, and a time T7).

Referring back to FIG. 4, the transmitting unit 66C transmits various types of information to the sheet inserting apparatus 36. Specifically, the transmitting unit 66C transmits signals, such as a sheet attribute, a feeding request, a sheet discharge ON signal, a sheet discharge OFF signal, and an insertion request, to the sheet inserting apparatus 36 via the communicating unit 71.

The sheet attribute is information indicating the sheet that is conveyed by the sheet conveying system 1. Specifically, in the embodiment, the sheet attribute include a type of a process applied to the first sheet 56 or the second sheet 58, the size of the first sheet 56 or the second sheet 58 (the length in the conveying direction), and type information of the first sheet 56 or the second sheet 58. The type of the process indicates a process performed by the post-processing apparatus 30 (in the embodiment, the post-processing apparatus 32, the post-processing apparatus 34, and the sheet inserting apparatus 36) installed downstream of the sheet conveying apparatus 10 in the conveying direction in the sheet conveying system 1. The type information indicates the type of paper used in a sheet, the thicknesses of a sheet, and the like.

The feeding request is a signal that is transmitted when requesting the post-processing apparatus 30 to transmit the insertion preparation time. The sheet discharge ON/OFF signal is transmitted when requesting each of the post-processing apparatuses 30 to convey the recording media (the first sheets 56 or the second sheets 58). An insertion request is transmitted when requesting the sheet inserting apparatus 36 to insert the second sheet 58.

The detecting unit 66D receives a detection signal from each of the sensors (the sensor 90A and the sensor 90B) provided in the sheet conveying apparatus 10. The conveying controlling unit 67 controls each of the conveying units 42 based on the detection signals received by the detecting unit 66D from the respective sensors 90A and 90B.

Figure 6:
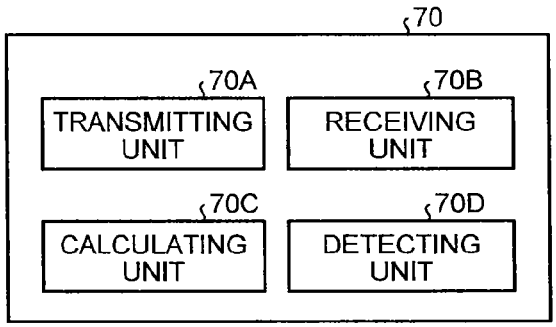
FIG. 6 is a functional block diagram of a system controlling unit.

The system controlling unit 70 in the sheet inserting apparatus 36 will now be explained in detail. FIG. 6 is a functional block diagram illustrating the system controlling unit 70.

As illustrated in FIG. 6, the system controlling unit 70 includes a transmitting unit 70A, a receiving unit 70B, a calculating unit 70C, and a detecting unit 70D. The receiving unit 70B receives various signals from the sheet conveying apparatus 10 via the communicating unit 73. Specifically, the receiving unit 70B receives signals, such as the sheet attribute of the second sheet 58, the feeding request, the sheet discharge ON signal, the sheet discharge OFF signal, and the insertion request, from the sheet conveying apparatus 10 via the communicating unit 73.

The calculating unit 70C calculates sheet interval information based on the sheet attribute received from the sheet conveying apparatus 10. Specifically, for example, after receiving sheet attribute of the first sheet 56 from the sheet conveying apparatus 10, the calculating unit 70C calculates the shortest conveying interval at which the sheet inserting apparatus 36 can receive the first sheet 56 when assuming that the first sheets 56 are conveyed sequentially, based on information included in the sheet attribute, such as information of the thickness, the size, and the paper type of the first sheet 56. The calculating unit 70C calculates the conveying interval as the sheet interval information.

The calculating unit 70C also calculates the insertion preparation time. The calculating unit 70C calculates the insertion preparation time based on the conveying speed of the second sheet 58 set in advance to the sheet inserting apparatus 36, the sheet attribute of the second sheet 58, and the like. Specifically, the calculating unit 70C calculates the difference between the conveying time of the second sheet 58 from the discharge position S to the merging point P (time T1) and the conveying time of the second sheet 58 from the sheet receiving surface Q to the merging point P (time T4) as illustrated in FIG. 5, as the insertion preparation time. The calculating unit 70C may also calculate, as the insertion preparation time, time obtained by adding time required for preparing for feeding, such as that required for preliminary excitation or starting fans, to the calculated difference.

Referring back to FIG. 6, the transmitting unit 70A transmits the insertion preparation time calculated by the calculating unit 70C to the sheet conveying apparatus 10. The transmitting unit 70A also transmits the sheet interval information calculated by the calculating unit 70C to the sheet conveying apparatus 10. The transmitting unit 70A also transmits a feed start signal and a feed end signal to the sheet conveying apparatus 10.

The feed start signal indicates that the second sheet 58 accumulated in the tray 50 is started being conveyed from the discharge position S to the insertion standby position Y along the conveying path B. The feed end signal indicates that the second sheet 58 reaches the insertion standby position Y (also see FIGS. 2 and 5).

The detecting unit 70D receives detection results from the sensors 90A to 90D provided in the sheet inserting apparatus 36.

A sequence of a conveying process performed in the sheet conveying system 1 will now be explained.

Figure 7:
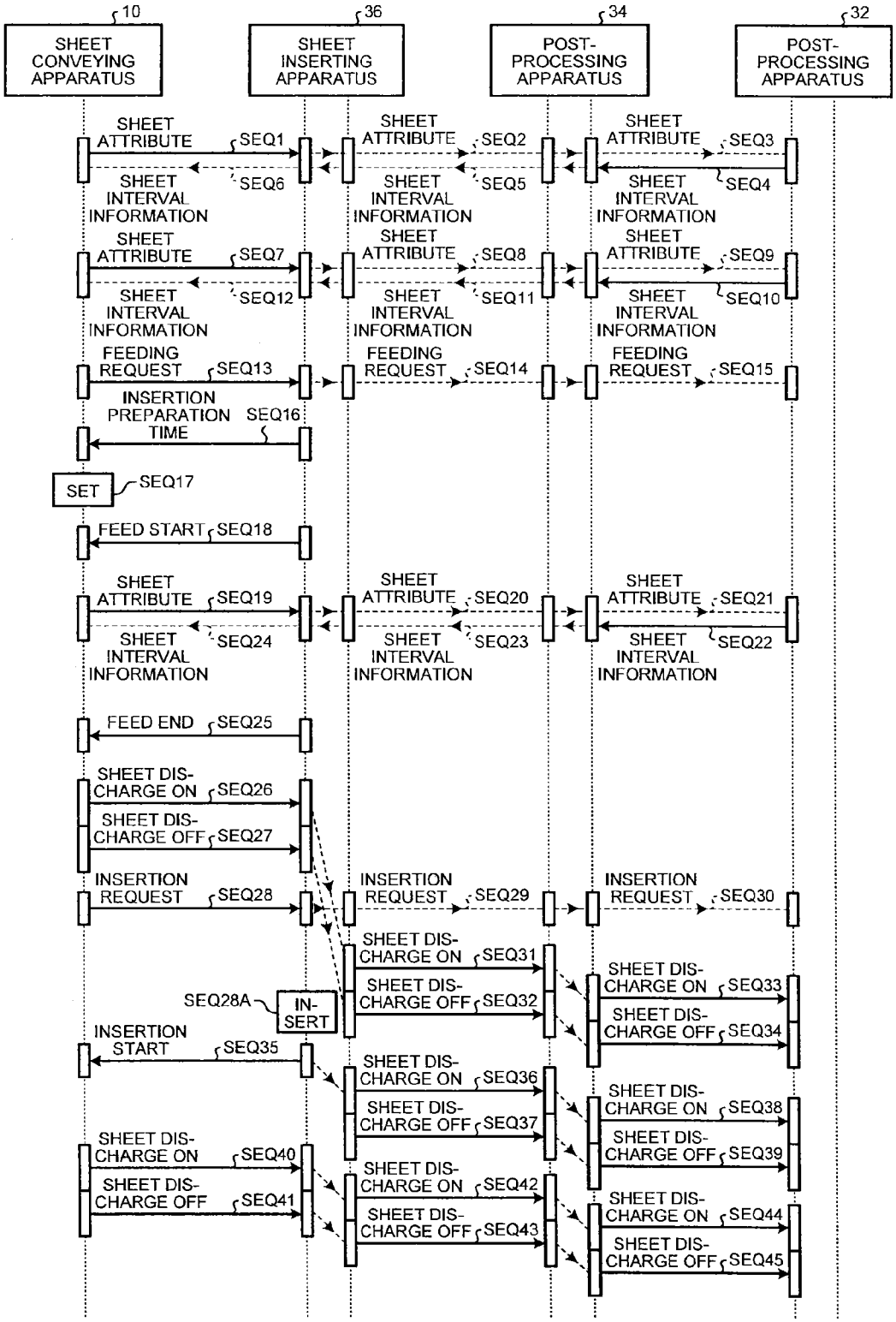
FIG. 7 is a sequence chart illustrating an example of a conveying process performed in the sheet conveying system.

FIG. 7 is a sequence chart illustrating an example of the conveying process performed in the sheet conveying system 1. FIG. 7 illustrates a sequence performed when a single second sheet 58 is inserted between a first sheet 56 and another first sheet 56, and three sheets consisting of the first sheet 56, the second sheet 58, and the first sheet 56 are conveyed sequentially.

To begin with, the sheet conveying apparatus 10 transmits the sheet attribute of the first sheet 56 to the sheet inserting apparatus 36 (SEQ1). After receiving the sheet attribute of the first sheet 56, the sheet inserting apparatus 36 transmits the received sheet attribute to the post-processing apparatus 34 (SEQ2). After receiving the sheet attribute of the first sheet 56, the post-processing apparatus 34 transmits the received sheet attribute of the first sheet 56 to the post-processing apparatus 32 (SEQ3).

After receiving the sheet attribute of the first sheet 56, each of the sheet inserting apparatus 36, the post-processing apparatus 34, and the post-processing apparatus 32 calculates sheet interval information of the first sheet 56.

The post-processing apparatus 32 then transmits the calculated sheet interval information of the first sheet 56 to the post-processing apparatus 34 (SEQ4). After receiving the sheet interval information from the post-processing apparatus 32, the post-processing apparatus 34 transmits longer one of the sheet interval information of the first sheet 56 calculated by the post-processing apparatus 34 and the sheet interval of the first sheet 56 received from the post-processing apparatus 32, to the sheet inserting apparatus 36 (SEQ5).

After receiving the sheet interval information from the post-processing apparatus 34, the sheet inserting apparatus 36 transmits longer one of the sheet interval information of the first sheet 56 calculated by the sheet inserting apparatus 36 and the sheet interval information of the first sheet 56 received from the post-processing apparatus 34, to the sheet conveying apparatus 10 (SEQ6).

The sheet conveying apparatus 10 then transmits the sheet attribute of the second sheet 58 to the sheet inserting apparatus 36 (SEQ7). After receiving the sheet attribute of the second sheet 58, the sheet inserting apparatus 36 transmits the received sheet attribute to the post-processing apparatus 34 (SEQ8). After receiving the sheet attribute of the second sheet 58, the post-processing apparatus 34 transmits the received sheet attribute of the second sheet 58 to the post-processing apparatus 32 (SEQ9).

After receiving the sheet attribute of the second sheet 58, each of the sheet inserting apparatus 36, the post-processing apparatus 34, and the post-processing apparatus 32 calculates sheet interval information being the first time of the second sheet 58.

The post-processing apparatus 32 then transmits the calculated sheet interval information of the second sheet 58 to the post-processing apparatus 34 (SEQ10). After receiving the sheet interval information from the post-processing apparatus 32, the post-processing apparatus 34 transmits longer one of the sheet interval information of the second sheet 58 calculated by the post-processing apparatus 34 and the sheet interval information of the second sheet 58 received from the post-processing apparatus 32, to the sheet inserting apparatus 36 (SEQ11).

After receiving the sheet interval information of the second sheet 58 from the post-processing apparatus 34, the sheet inserting apparatus 36 transmits longer one of the sheet interval information of the second sheet 58 calculated by the sheet inserting apparatus 36 and the sheet interval information of the second sheet 58 received from the post-processing apparatus 34, to the sheet conveying apparatus 10 as the sheet interval information being the first time of the second sheet 58 (SEQ12).

The sheet conveying apparatus 10 then outputs a feeding request to the sheet inserting apparatus 36 (SEQ13). After receiving the feeding request, the sheet inserting apparatus 36 calculates the insertion preparation time.

Further, the sheet conveying apparatus 10 outputs a feeding request to the post-processing apparatus 34 (SEQ14). The post-processing apparatus 34 transmits a feeding request to the post-processing apparatus 32 (SEQ15).

The sheet inserting apparatus 36 then transmits the calculated insertion preparation time to the sheet conveying apparatus 10 (SEQ16). After receiving the insertion preparation time, the sheet conveying apparatus 10 sets the time indicated by longer one of the received sheet interval information being the first time of the second sheet 58 and the insertion preparation time, as an insertion interval to insert the second sheet 58 (SEQ17). The sheet inserting apparatus 36 then transmits a feed start signal to the sheet conveying apparatus 10 (SEQ18).

The sheet conveying apparatus 10 then transmits the sheet attribute of the first sheet 56 to the sheet inserting apparatus 36 (SEQ19). After receiving the sheet attribute of the first sheet 56, the sheet inserting apparatus 36 transmits the received sheet attribute to the post-processing apparatus 34 (SEQ20). After receiving the sheet attribute of the first sheet 56, the post-processing apparatus 34 transmits the received sheet attribute of the first sheet 56 to the post-processing apparatus 32 (SEQ21).

After receiving the sheet attribute of the first sheet 56, each of the sheet inserting apparatus 36, the post-processing apparatus 34, and the post-processing apparatus 32 calculates sheet interval information of the first sheet 56.

The post-processing apparatus 32 then transmits the calculated sheet interval information of the first sheet 56 to the post-processing apparatus 34 (SEQ22). After receiving the sheet interval from the post-processing apparatus 32, the post-processing apparatus 34 transmits longer one of the sheet interval information of the first sheet 56 calculated by the post-processing apparatus 34 and the sheet interval of the first sheet 56 received from the post-processing apparatus 32 to the sheet inserting apparatus 36 (SEQ23).

After receiving the sheet interval information from the post-processing apparatus 34, the sheet inserting apparatus 36 transmits longer one of the sheet interval information of the first sheet 56 calculated by the sheet inserting apparatus 36 and the sheet interval information of the first sheet 56 received from the post-processing apparatus 34 to the sheet conveying apparatus 10 (SEQ24).

The sheet inserting apparatus 36, when detecting that the second sheet 58 is conveyed to the insertion standby position Y, transmits a feed end signal to the sheet conveying apparatus 10 (SEQ25).

The sheet conveying apparatus 10 then transmits a sheet discharge ON signal of the first sheet 56 to the sheet inserting apparatus 36 at the timing at which the first sheet 56 reaches the sheet discharge surface R and is discharged to the sheet inserting apparatus 36 (SEQ26). The timing at which the first sheet 56 reaches the sheet discharge surface R can be determined based on a detection signal from the sensor 90B. The sheet conveying apparatus 10 then transmits a sheet discharge OFF signal of the first sheet 56 to the sheet inserting apparatus 36 (SEQ27).

The sheet conveying apparatus 10 then transmits an insertion request representing an instruction to insert the second sheet 58 to the sheet inserting apparatus 36 at the timing at which a virtually conveyed sheet M reaches the sheet discharge surface R and is discharged to the sheet inserting apparatus 36 (SEQ28). The timing at which the virtually conveyed sheet M reaches the sheet discharge surface R and is discharged to the sheet inserting apparatus 36 may be determined by considering it to be the timing at which the insertion interval set at SEQ17 elapses after the trailing end of the immediately-prior first sheet 56 in the conveying direction reaches the sheet discharge surface R and detected by the sensor 90B.

After receiving the insertion request, the sheet inserting apparatus 36 transmits the insertion request to the post-processing apparatus 34 (SEQ29). The sheet inserting apparatus 36 then performs an insertion process of conveying the second sheet 58 at the insertion standby position Y toward the merging point P (SEQ28A).

After receiving the insertion request, the post-processing apparatus 34 transmits the insertion request to the post-processing apparatus 32 (SEQ30).

After receiving the sheet discharge OFF signal of the first sheet 56 subsequent to the sheet discharge ON signal of the first sheet 56 at SEQ26 and SEQ27, the sheet inserting apparatus 36 transmits a sheet discharge ON signal and a sheet discharge OFF signal of the first sheet 56 sequentially to the post-processing apparatus 34 (SEQ31, SEQ32). The post-processing apparatus 34 then transmits a sheet discharge ON signal and a sheet discharge OFF signal of the first sheet 56 sequentially to the post-processing apparatus 32 (SEQ33, SEQ34).

After performing the insertion process of inserting the second sheet 58 at SEQ28A, the sheet inserting apparatus 36 transmits an insertion start signal of the second sheet 58 to the sheet conveying apparatus 10 (SEQ35). The sheet inserting apparatus 36 also transmits a sheet discharge OFF signal of the second sheet 58 subsequent to a sheet discharge ON signal of the second sheet 58 to the post-processing apparatus 34 (SEQ36, SEQ37). The post-processing apparatus 34 then transmits a sheet discharge ON signal and a sheet discharge OFF signal of the second sheet 58 sequentially to the post-processing apparatus 32 (SEQ38, SEQ39).

After receiving the insertion start signal at SEQ35, the sheet conveying apparatus 10 transmits a sheet discharge ON signal of the first sheet 56 to the sheet inserting apparatus 36 (SEQ40). The sheet conveying apparatus 10 then transmits a sheet discharge OFF signal of the first sheet 56 to the sheet inserting apparatus 36 (SEQ41).

The sheet inserting apparatus 36 transmits a sheet discharge ON signal and a sheet discharge OFF signal of the first sheet 56 sequentially to the post-processing apparatus 34 (SEQ42, SEQ43). The post-processing apparatus 34 transmits a sheet discharge ON signal and a sheet discharge OFF signal of the first sheet 56 to the post-processing apparatus 32 (SEQ44, SEQ45).

When receiving the sheet discharge ON signal and the sheet discharge OFF signal of the first sheet 56, each of the post-processing apparatuses 30 conveys the first sheet 56. When receiving the sheet discharge ON signal and the sheet discharge OFF signal of the second sheet 58, each of the post-processing apparatuses 30 conveys the second sheet 58.

The conveying process performed by the sheet conveying apparatus 10 will now be explained.

Figure 8:
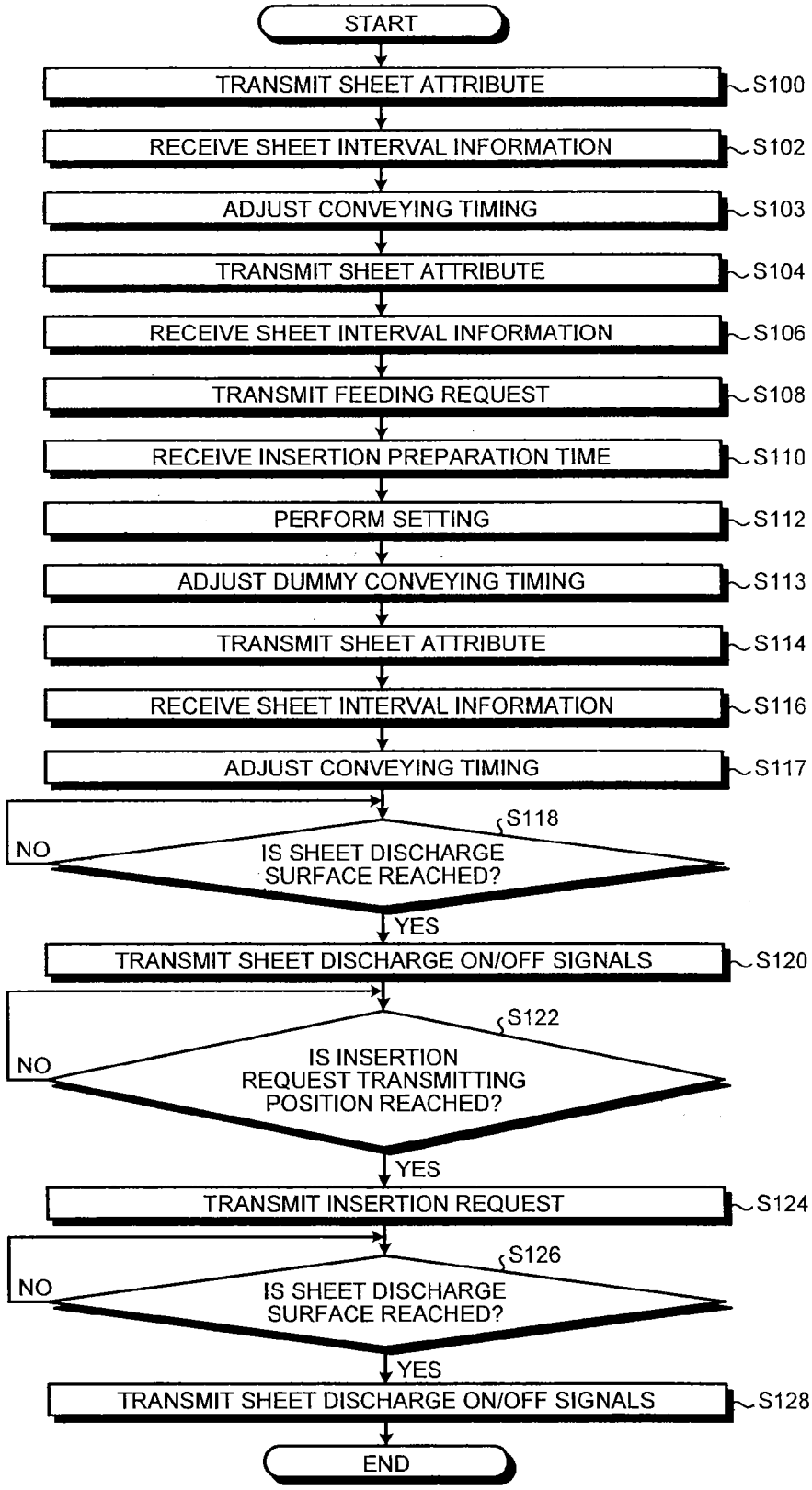
FIG. 8 is a flowchart illustrating an example of a conveying process performed by the sheet conveying apparatus.

FIG. 8 is a flowchart illustrating the conveying process performed by the sheet conveying apparatus 10. FIG. 8 illustrates a sequence performed when a single second sheet 58 is inserted between a first sheet 56 and another first sheet 56, and three sheets consisting of the first sheet 56, the second sheet 58, and the first sheet 56 are conveyed sequentially, in the same manner as that illustrated in FIG. 7.

To begin with, the transmitting unit 66C in the system controlling unit 66 transmits the sheet attribute of the first sheet 56 to the sheet inserting apparatus 36 (Step S100). The sheet attribute of the first sheet 56 may be stored in advance in and read from a memory not illustrated. The receiving unit 66A then receives the sheet interval information of the first sheet 56 from the sheet inserting apparatus 36 (Step S102).

After receiving the sheet interval information of the first sheet 56, in the sheet conveying apparatus 10, the conveying controlling unit 67 controls the conveying units 42 to adjust conveying timing so that the conveying controlling unit 67 starts conveying the first sheets 56 at a conveying interval (conveying time interval) that is based on the received sheet interval information of the first sheet 56 (Step S103). Thereby, the first sheet 56 starts being conveyed.

The transmitting unit 66C then transmits the sheet attribute of the second sheet 58 to the sheet inserting apparatus 36 (Step S104). The sheet attribute of the second sheet 58 may be stored in advance in a memory not illustrated and read from the memory. The receiving unit 66A then receives the sheet interval information being the first time of the second sheet 58 from the sheet inserting apparatus 36 (Step S106).

The transmitting unit 66C then transmits a feeding request of the second sheet 58 to the sheet inserting apparatus 36 (Step S108). The receiving unit 66A then receives an insertion preparation time from the sheet inserting apparatus 36 (Step S110).

The setting unit 66B then sets the time indicated by longer one of the insertion preparation time received at Step S110 and the sheet interval information being the first time of the second sheet 58 received at Step S106, as an insertion interval to insert the second sheet 58 (Step S112).

The conveying controlling unit 67 then controls the conveying unit 42 to convey the first sheets 56 such that an interval extended by an interval corresponding to an added value obtained by adding the conveying time corresponding to the length of the second sheet 58 in the conveying direction to the insertion interval set at Step S112 is provided between the first sheets 56. In this manner, the conveying controlling unit 67 adjusts dummy conveying timing that is the conveying timing of the virtually conveyed sheet M (Step S113).

Through the process at Step S113, the first sheets 56 are conveyed such that an interval obtained by adding the interval according to the sheet interval information of the first sheet 56 to the interval corresponding to the added value is provided between the first sheets 56 at a position where the second sheet 58 is to be inserted. In other words, the first sheets 56 are conveyed such that the interval obtained by assuming that a virtually conveyed sheet M is positioned between the first sheets 56 is provided between the first sheets 56.

The transmitting unit 66C then transmits the sheet attribute of the first sheet 56 to the sheet inserting apparatus 36 (Step S114). The receiving unit 66A then receives the sheet interval information of the first sheet 56 (Step S116).

After receiving the sheet interval information of the first sheet 56, the sheet conveying apparatus 10 controls the conveying unit 42 to adjust the conveying timing so that the first sheet 56 starts to be conveyed in a manner spaced from the downstream edge of the virtually conveyed sheet M in the conveying direction by the interval according to the sheet interval information of the first sheet 56 (Step S117). In this manner, the first sheet 56 starts being conveyed following the virtually conveyed sheet M.

The system controlling unit 66 then determines if the first sheet 56 reaches the sheet discharge surface R (Step S118), and repeatedly determines No (No at Step S118) until the system controlling unit 66 determines Yes (Yes at Step S118). At Step S118, the system controlling unit 66 makes the determination at Step S118 based on whether the detection result indicating that the first sheet 56 is detected is received from the sensor 90B in the detecting unit 66D.

When the system controlling unit 66 determines Yes at Step S118 (Yes at Step S118), the process goes to Step S120. At Step S120, the transmitting unit 66C transmits a sheet discharge ON signal and a sheet discharge OFF signal of the first sheet 56 to the sheet inserting apparatus 36 (Step S120).

The system controlling unit 66 then determines if the virtually conveyed sheet M reaches the insertion request transmitting position U (Step S122), and repeatedly determines No (No at Step S122) until the system controlling unit 66 determines Yes (Yes at Step S122).

The determination at Step S122 can be made based on whether the insertion interval set at Step S112 has elapsed after the sensor 90B detects the most downstream edge of the first sheet 56 in the conveying direction. When Yes is determined at Step S122 (Yes at Step S122), the process goes to Step S124. At Step S124, the transmitting unit 66C transmits an insertion request to the sheet inserting apparatus 36 (Step S124).

The system controlling unit 66 then determines if the first sheet 56 reaches the sheet discharge surface R (Step S126), and repeatedly determines No (No at Step S126) until the system controlling unit 66 determines Yes (Yes at Step S126). At Step S126, the system controlling unit 66 makes the determination at Step S126 based on whether the detecting unit 66D receives a detection result indicating that the first sheet 56 is detected from the sensor 90B.

When Yes is determined at Step S126 (Yes at Step S126), the process goes to Step S128. At Step S128, the transmitting unit 66C transmits a sheet discharge ON signal and a sheet discharge OFF signal of the first sheet 56 to the sheet inserting apparatus 36 (Step S128). This routine is then ended.

The conveying process performed in the sheet inserting apparatus 36 will now be explained.

Figure 9:
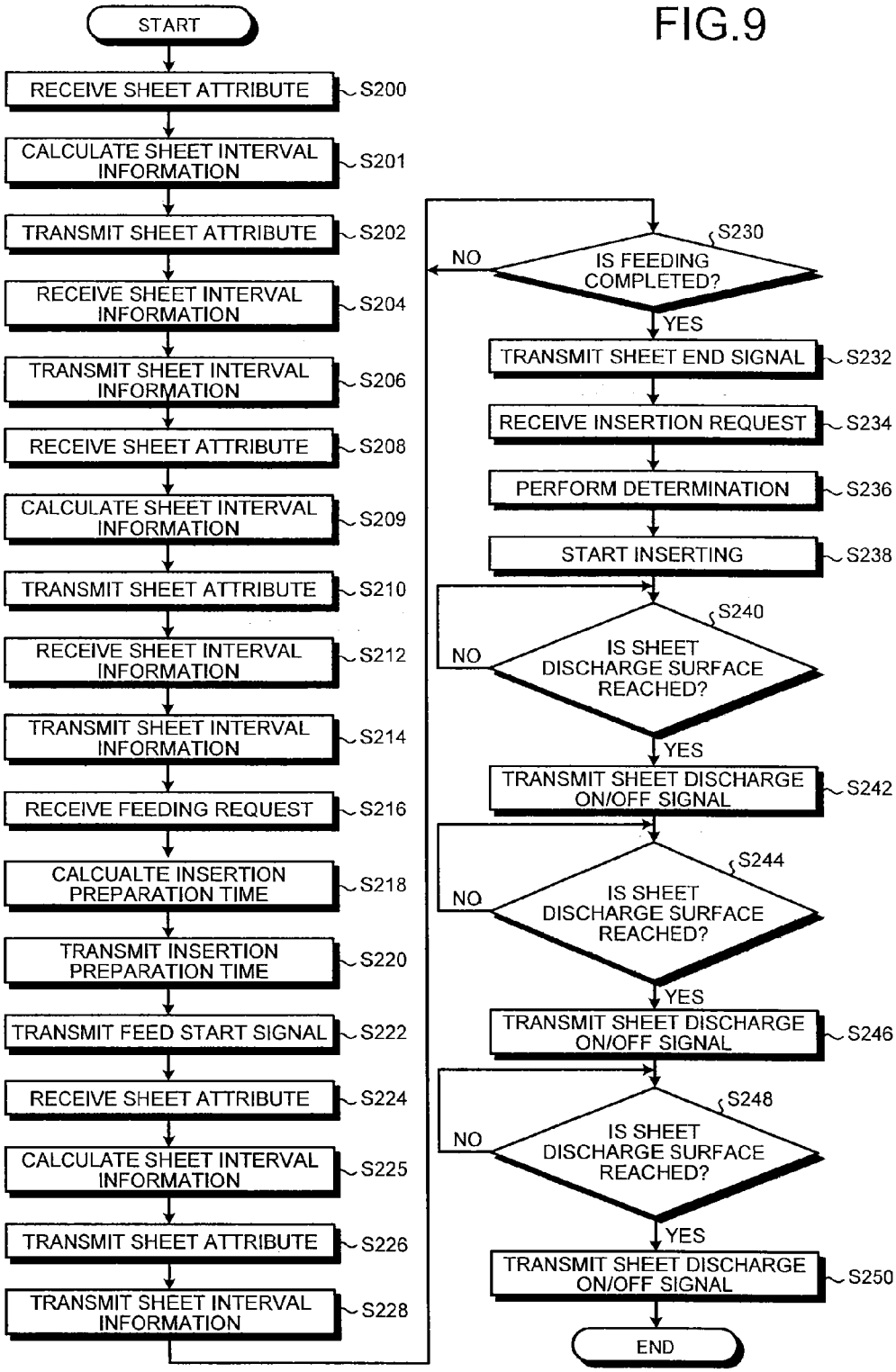
FIG. 9 is a flowchart illustrating an example of a conveying process performed by the sheet inserting apparatus.

FIG. 9 is a flowchart illustrating the conveying process performed in the sheet inserting apparatus 36. FIG. 9 illustrates a sequence performed when a single second sheet 58 is inserted between a first sheet 56 and another first sheet 56, and three sheets consisting of the first sheet 56, the second sheet 58, and the first sheet 56 are conveyed sequentially, in the same manner as that illustrated in FIG. 7.

To begin with, the receiving unit 70B in the system controlling unit 70 receives the sheet attribute of the first sheet 56 (Step S200). When the receiving unit 70B receives the sheet attribute of the first sheet 56, the calculating unit 70C calculates sheet interval information of the first sheet 56 (Step S201). The transmitting unit 70A then transmits the received sheet attribute of the first sheet 56 to the post-processing apparatus 34 (Step S202).

The receiving unit 70B then receives the sheet interval information of the first sheet 56 from the post-processing apparatus 34 (Step S204). The transmitting unit 70A then transmits longer one of the sheet interval information of the first sheet 56 calculated by the calculating unit 70C at Step S201 and the sheet interval information received at Step S204, to the sheet conveying apparatus 10 (Step S206).

The receiving unit 70B then receives the sheet attribute of the second sheet 58 from the sheet conveying apparatus 10 (Step S208). When the receiving unit 70B receives the sheet attribute of the second sheet 58, the calculating unit 70C calculates sheet interval information of the second sheet 58 (Step S209). The transmitting unit 70A transmits the sheet attribute of the second sheet 58 to the post-processing apparatus 34 (Step S210).

When the receiving unit 70B receives the sheet interval information of the second sheet 58 from the post-processing apparatus 34 (Step S212), the transmitting unit 70A transmits longer one of the sheet interval information of the second sheet 58 calculated by the calculating unit 70C at Step S209 and the sheet interval information received at Step S212, as the sheet interval information being the first time of the second sheet 58 to the sheet conveying apparatus 10 (Step S214).

The receiving unit 70B then receives a feeding request from the sheet conveying apparatus 10 (Step S216). After receiving the feeding request, the conveying controlling unit 74 starts the conveying process of conveying the second sheet 58 accumulated in the tray 50 from the discharge position S toward the insertion standby position Y along the conveying path B, by controlling the conveying unit 62.

The calculating unit 70C then calculates the insertion preparation time (Step S218). The transmitting unit 70A then transmits the calculated insertion preparation time to the sheet conveying apparatus 10 (Step S220). The transmitting unit 70A then transmits a feed start signal to the sheet conveying apparatus 10 (Step S222).

The receiving unit 70B then receives the sheet attribute of the first sheet 56 from the sheet conveying apparatus 10 (Step S224). When the receiving unit 70B receives the sheet attribute of the first sheet 56, the calculating unit 70C calculates sheet interval information of the first sheet 56 (Step S225). The transmitting unit 70A then transmits the received sheet attribute of the first sheet 56 to the post-processing apparatus 34 (Step S226).

The receiving unit 70B then receives the sheet interval information of the first sheet 56 from the post-processing apparatus 34 (Step S228). The system controlling unit 70 determines if feeding is completed (Step S230). The determination at Step S230 is made by causing the detecting unit 70D to determine if the second sheet 58 is detected by the sensor 90F.

The transmitting unit 70A then transmits a feed end signal of the second sheet 58 to the sheet conveying apparatus 10 (Step S232). The receiving unit 70B receives the insertion request from the sheet conveying apparatus 10 (Step S234). The calculating unit 70C determines a third time which is used so that the second sheet 58 at the insertion standby position Y is merged at the merging point P after the third time elapses after the insertion request is received (Step S236).

Specifically, as illustrated in FIG. 5, the calculating unit 70C adds the time for conveying the virtually conveyed sheet M (the second sheet 58) from the sheet receiving surface Q to the merging point P (time T4) to an insertion waiting time (time T5) being the conveying time from the insertion request transmitting position U to the sheet discharge surface R, subtracts the time for conveying the second sheet 58 from the insertion standby position Y to the merging point P (time T3) from the result of the addition, and fixes the result (time T5+time T4−time T3) as the third time.

As illustrated in FIG. 5, the calculating unit 70C may fix a result of subtracting the time for conveying the second sheet 58 from the insertion standby position Y to the merging point P (time T3) from the sum of the time for conveying the virtually conveyed sheet M (the second sheet 58) from the sheet receiving surface Q to the merging point P (time T4) and the time for conveying the virtually conveyed sheet M (the second sheet 58) from the insertion request transmitting position U to the sheet discharge surface R (time T5) (time T4+time T5−time T3), as the third time.

The conveying controlling unit 74 starts inserting the second sheet 58 by controlling the conveying unit 62 to start the insertion process (Step S238). At Step S238, more specifically, the conveying controlling unit 74 starts the insertion process of causing the second sheet 58 at the insertion standby position Y to be merged at the merging point P when the third time determined at Step S236 elapses after the insertion request is received at Step S234.

Through the process at Step S238, the second sheet 58 is inserted after the first sheet 56.

The detecting unit 70D determines if the first one of the first sheets 56 reaches the sheet discharge surface W (Step S240). The determination at Step S240 is made by determining if a detection signal of the first sheet 56 is received from the sensor 90G.

Until Yes is determined at Step S240 (Yes at Step S240), No is repeatedly determined (No at Step S240). When Yes is determined, the process goes to Step S242.

At Step S242, a sheet discharge ON signal and a sheet discharge OFF signal of the first sheet 56 are transmitted to the post-processing apparatus 34 (Step S242). If the second sheet 58 inserted at Step S238 reaches the sheet discharge surface W is then determined (Step S244). The determination at Step S244 is made by determining if a detection signal of the second sheet 58 is received from the sensor 90G.

At Step S246, a sheet discharge ON signal and a sheet discharge OFF signal of the second sheet 58 are transmitted to the post-processing apparatus 34 (Step S246).

If the first sheet 56 reaches the sheet discharge surface W is then determined (Step S248). The determination at Step S248 is made by determining if a detection signal of the first sheet 56 is received from the sensor 90G.

At Step S248, the detecting unit 70D repeatedly determines No (No at Step S248) until the detecting unit 70D determines Yes (Yes at Step S248). If Yes is determined at Step S248, the process goes to Step S250. At Step S250, a sheet discharge ON signal and a sheet discharge OFF signal of the first sheet 56 are transmitted to the post-processing apparatus 34 (Step S250), and this routine is ended.

Another example of the sequence of the conveying process performed in the sheet conveying system 1 will now be explained.

Figure 10:
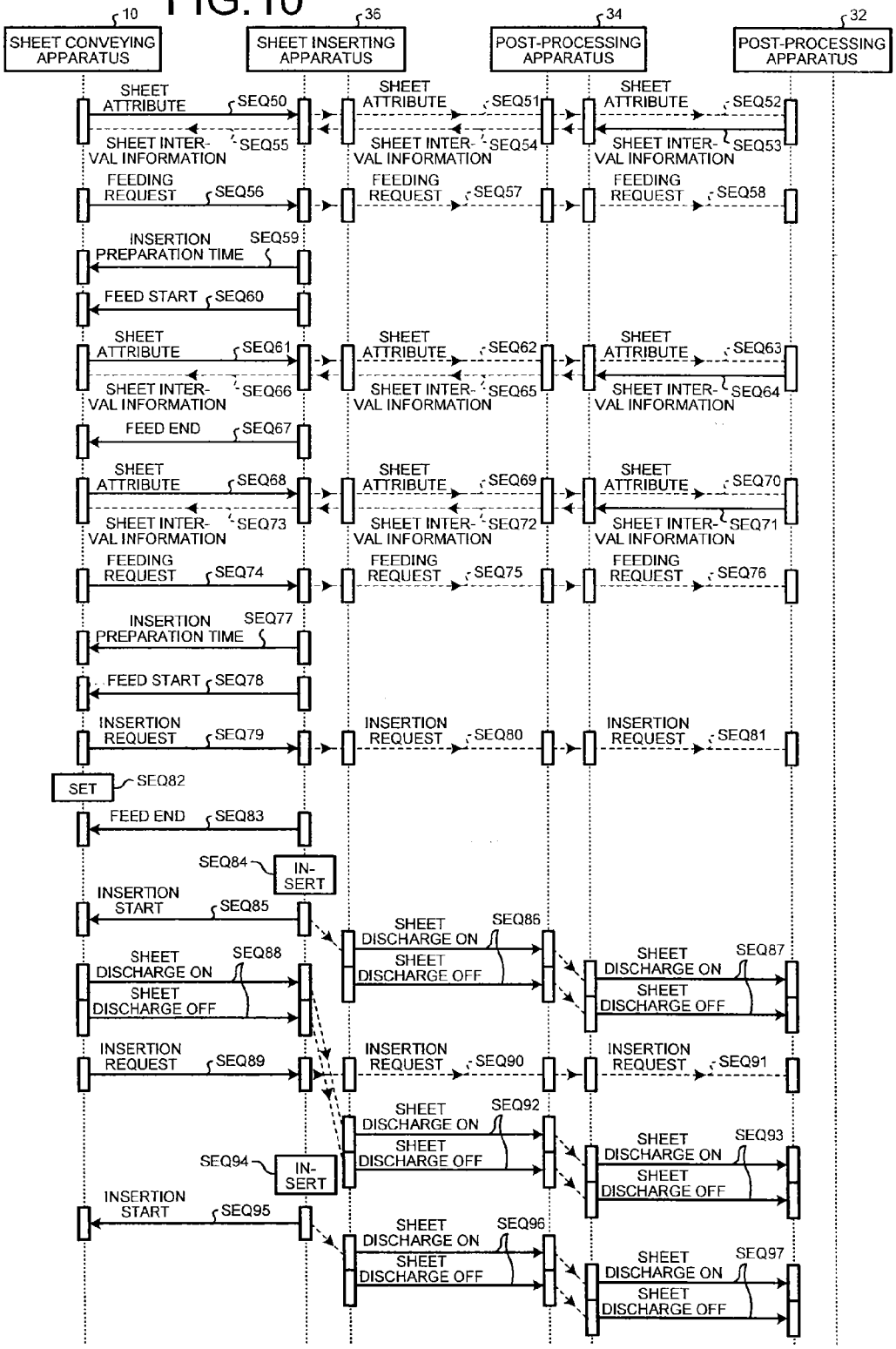
FIG. 10 is a sequence chart illustrating another example of the conveying process performed in the sheet conveying system.

FIG. 10 is a sequence chart illustrating another example of the conveying process performed in the sheet conveying system 1. FIG. 10 illustrates a sequence of an example in which three sheets consisting of a second sheet 58, a first sheet 56, and another second sheet 58 are conveyed sequentially in the described order.

To begin with, the sheet conveying apparatus 10 transmits sheet attribute of the second sheet 58 to the sheet inserting apparatus 36 (SEQ50). After receiving the sheet attribute of the second sheet 58, the sheet inserting apparatus 36 transmits the received sheet attribute to the post-processing apparatus 34 (SEQ51). After receiving the sheet attribute of the second sheet 58, the post-processing apparatus 34 transmits the received sheet attribute of the second sheet 58 to the post-processing apparatus 32 (SEQ52).

After receiving the sheet attribute of the second sheet 58, each of the sheet inserting apparatus 36, the post-processing apparatus 34, and the post-processing apparatus 32 calculates sheet interval information being first information of the second sheet 58.

The post-processing apparatus 32 then transmits the calculated sheet interval information of the second sheet 58 to the post-processing apparatus 34 (SEQ53). After receiving the sheet interval information from the post-processing apparatus 32, the post-processing apparatus 34 transmits longer one of the sheet interval information of the second sheet 58 calculated by the post-processing apparatus 34 and the sheet interval information of the second sheet 58 received from the post-processing apparatus 32, to the sheet inserting apparatus 36 (SEQ54).

After receiving the sheet interval information of the second sheet 58 from the post-processing apparatus 34, the sheet inserting apparatus 36 transmits longer one of the sheet interval information of the second sheet 58 calculated by the sheet inserting apparatus 36 and the sheet interval information of the second sheet 58 received from the post-processing apparatus 34 to the sheet conveying apparatus 10, as the sheet interval information being the first time of the second sheet 58 (SEQ55).

The sheet conveying apparatus 10 then outputs a feeding request to the sheet inserting apparatus 36 (SEQ56). After receiving the feeding request, the sheet inserting apparatus 36 calculates the insertion preparation time.

Further, the sheet conveying apparatus 10 outputs the feeding request to the post-processing apparatus 34 (SEQ57). The post-processing apparatus 34 transmits the feeding request to the post-processing apparatus 32 (SEQ58).

The sheet inserting apparatus 36 then transmits the calculated insertion preparation time to the sheet conveying apparatus 10 (SEQ59). After receiving the insertion preparation time, the sheet conveying apparatus 10 sets the time indicated by longer one of the received sheet interval information being the first time of the second sheet 58 and the insertion preparation time, as the insertion interval to insert the second sheet 58. The sheet inserting apparatus 36 then transmits a feed start signal to the sheet conveying apparatus 10 (SEQ60).

The sheet conveying apparatus 10 then transmits the sheet attribute of the first sheet 56 to the sheet inserting apparatus 36 (SEQ61). After receiving the sheet attribute of the first sheet 56, the sheet inserting apparatus 36 transmits the received sheet attribute to the post-processing apparatus 34 (SEQ62). After receiving the sheet attribute of the first sheet 56, the post-processing apparatus 34 transmits the received sheet attribute of the first sheet 56 to the post-processing apparatus 32 (SEQ63).

After receiving the sheet attribute of the first sheet 56, each of the sheet inserting apparatus 36, the post-processing apparatus 34, and the post-processing apparatus 32 calculates sheet interval information of the first sheet 56.

The post-processing apparatus 32 then transmits the calculated sheet interval information of the first sheet 56 to the post-processing apparatus 34 (SEQ64). After receiving the sheet interval information from the post-processing apparatus 32, the post-processing apparatus 34 transmits longer one of the sheet interval information of the first sheet 56 calculated by the post-processing apparatus 34 and the sheet interval of the first sheet 56 received from the post-processing apparatus 32, to the sheet inserting apparatus 36 (SEQ65).

After receiving the sheet interval information from the post-processing apparatus 34, the sheet inserting apparatus 36 transmits longer one of the sheet interval information of the first sheet 56 calculated by the sheet inserting apparatus 36 and the sheet interval information of the first sheet 56 received from the post-processing apparatus 34, to the sheet conveying apparatus 10 (SEQ66).

The sheet inserting apparatus 36 then transmits a feed end signal of the second sheet 58 to the sheet conveying apparatus 10 (SEQ67).

The sheet conveying apparatus 10 then transmits the sheet attribute of the second sheet 58 to the sheet inserting apparatus 36 (SEQ68). After receiving the sheet attribute of the second sheet 58, the sheet inserting apparatus 36 transmits the received sheet attribute to the post-processing apparatus 34 (SEQ69). After receiving the sheet attribute of the second sheet 58, the post-processing apparatus 34 transmits the received sheet attribute of the second sheet 58 to the post-processing apparatus 32 (SEQ70).

After receiving the sheet attribute of the second sheet 58, each of the sheet inserting apparatus 36, the post-processing apparatus 34, and the post-processing apparatus 32 calculates sheet interval information being first information of the second sheet 58.

The post-processing apparatus 32 then transmits the calculated sheet interval information of the second sheet 58 to the post-processing apparatus 34 (SEQ71). After receiving the sheet interval information from the post-processing apparatus 32, the post-processing apparatus 34 transmits longer one of the sheet interval information of the second sheet 58 calculated by the post-processing apparatus 34 and the sheet interval information of the second sheet 58 received from the post-processing apparatus 32, to the sheet inserting apparatus 36 (SEQ72).

After receiving the sheet interval information of the second sheet 58 from the post-processing apparatus 34, the sheet inserting apparatus 36 transmits longer one of the sheet interval information of the second sheet 58 calculated by the sheet inserting apparatus 36 and the sheet interval information of the second sheet 58 received from the post-processing apparatus 34, to the sheet conveying apparatus 10 as the sheet interval information being the first time of the second sheet 58 (SEQ73).

The sheet conveying apparatus 10 then outputs a feeding request to the sheet inserting apparatus 36 (SEQ74). After receiving the feeding request, the sheet inserting apparatus 36 calculates the insertion preparation time.

The sheet conveying apparatus 10 also outputs the feeding request to the post-processing apparatus 34 (SEQ75). The post-processing apparatus 34 then transmits the feeding request to the post-processing apparatus 32 (SEQ76).

The sheet inserting apparatus 36 then transmits the calculated insertion preparation time to the sheet conveying apparatus 10 (SEQ77). After receiving the insertion preparation time, the sheet conveying apparatus 10 sets the time indicated by longer one of the received sheet interval information being the first time of the second sheet 58 and the insertion preparation time, as the insertion interval to insert the second sheet 58. The sheet inserting apparatus 36 then transmits a feed start signal to the sheet conveying apparatus 10 (SEQ78).

The sheet conveying apparatus 10 then transmits an insertion request of the second sheet 58 to the sheet inserting apparatus 36 (SEQ79). After receiving the insertion request, the sheet inserting apparatus 36 transmits the insertion request to the post-processing apparatus 34 (SEQ80). After receiving the insertion request, the post-processing apparatus 34 transmits the insertion request to the post-processing apparatus 32 (SEQ81).

The sheet conveying apparatus 10 then sets the time indicated by longer one of the insertion preparation time received at SEQ77 and the sheet interval information being the first time of the second sheet 58 received at SEQ73, as the insertion interval to insert the second sheet 58 (SEQ82).

When detecting that the second sheet 58 is conveyed to the insertion standby position Y in the sheet inserting apparatus 36, the sheet inserting apparatus 36 transmits a feed end signal to the sheet conveying apparatus 10 (SEQ83).

The sheet inserting apparatus 36 then executes the insertion process of conveying the second sheet 58 positioned at the insertion standby position Y to the merging point P (SEQ84). The sheet inserting apparatus 36 then transmits the insertion start signal to the sheet conveying apparatus 10 (SEQ85).

The sheet inserting apparatus 36 then transmits a sheet discharge ON signal and a sheet discharge OFF signal of the first one of the second sheets 58 to the post-processing apparatus 34 (SEQ86). The post-processing apparatus 34 then transmits a sheet discharge ON signal and a sheet discharge OFF signal of the first one of the second sheets 58 to the post-processing apparatus 32 (SEQ87).

The sheet conveying apparatus 10 then transmit a sheet discharge ON signal of the first sheet 56 to the sheet inserting apparatus 36 at the timing at which the first sheet 56 reaches the sheet discharge surface R and is discharged to the sheet inserting apparatus 36, and transmits a sheet discharge OFF signal of the first sheet 56 to the sheet inserting apparatus 36 (SEQ88). The timing at which the first sheet 56 reaches the sheet discharge surface R can be determined based on a detection signal of the sensor 90B.

The sheet conveying apparatus 10 then transmits an insertion request representing an insertion instruction of the second sheet 58, to the sheet inserting apparatus 36 at the timing at which the virtually conveyed sheet M reaches the sheet discharge surface R and is discharged to the sheet inserting apparatus 36 (SEQ89). The timing at which the virtually conveyed sheet M reaches the sheet discharge surface R and is discharged to the sheet inserting apparatus 36 may be determined by considering it to be the timing apart from when the sensor 90B detects that the trailing end of the preceding first sheet 56 in the conveying direction reaches the sheet discharge surface R, by the insertion interval set in the manner described above.

After receiving the insertion request, the sheet inserting apparatus 36 transmits the insertion request of the second sheet 58 to the post-processing apparatus 34 (SEQ90). The post-processing apparatus 34 then transmits the insertion request of the second sheet 58 to the post-processing apparatus 32 (SEQ91).

The sheet inserting apparatus 36 then transmits a sheet discharge ON signal and a sheet discharge OFF signal of the first sheet 56 to the post-processing apparatus 34 (SEQ92). The post-processing apparatus 34 then transmits a sheet discharge ON signal and a sheet discharge OFF signal of the first sheet 56 to the post-processing apparatus 32 (SEQ93).

After receiving the insertion request of the second sheet 58, the sheet inserting apparatus 36 inserts a second sheet 58 in a manner similar to that at SEQ28A (see FIG. 7) (SEQ94). An insertion start signal of the second sheet 58 is then transmitted to the sheet conveying apparatus 10 (SEQ95).

The sheet inserting apparatus 36 then transmits a sheet discharge ON signal and a sheet discharge OFF signal of the second sheet 58 to the post-processing apparatus 34 (SEQ96). The post-processing apparatus 34 then transmits a sheet discharge ON signal and a sheet discharge OFF signal of the second sheet 58 to the post-processing apparatus 32 (SEQ97).

The conveying process performed by the sheet conveying apparatus 10 will now be explained.

Figure 11:
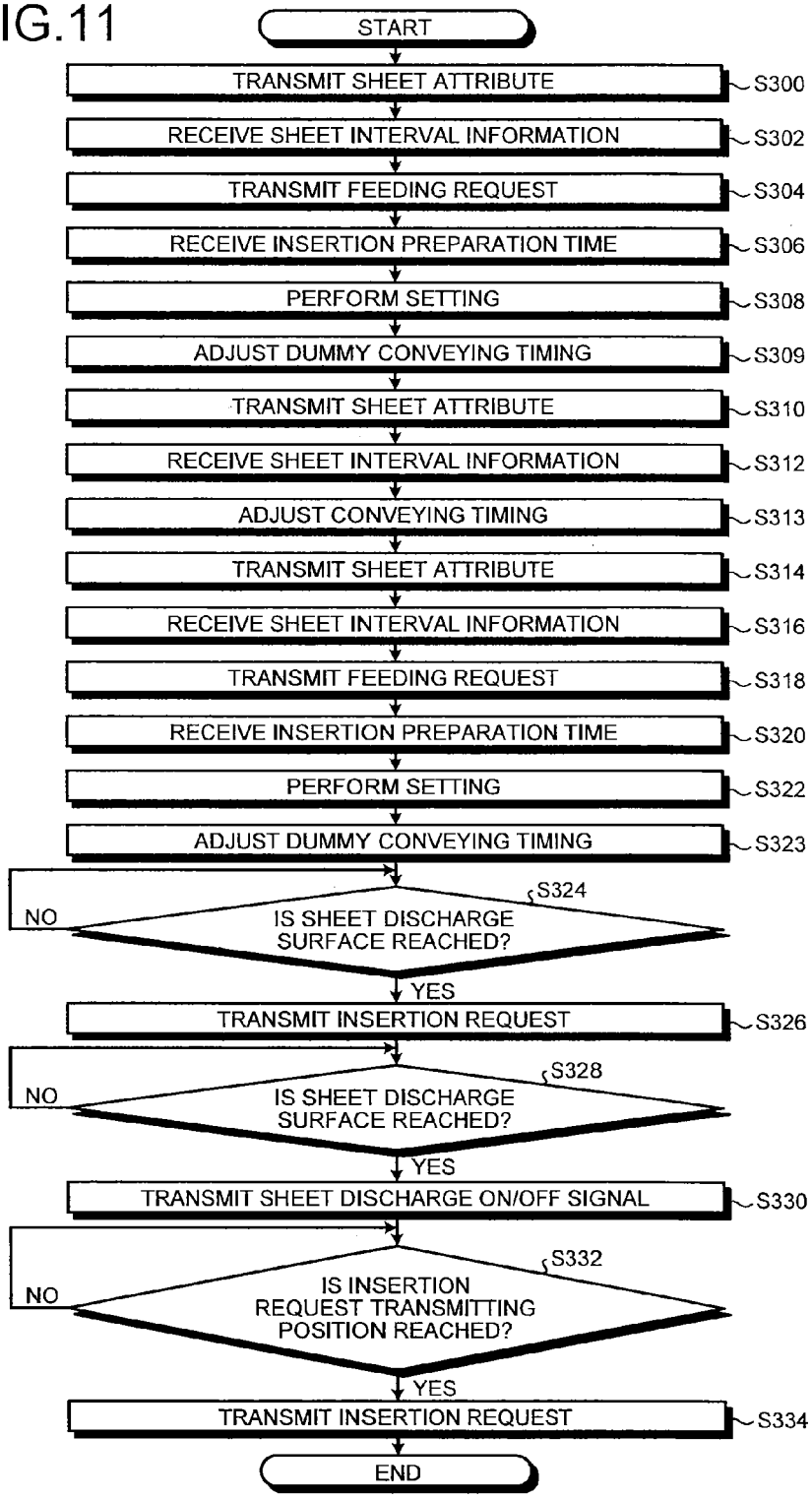
FIG. 11 is a flowchart illustrating another example of the conveying process performed in the sheet conveying apparatus.

FIG. 11 is a flowchart illustrating the conveying process performed in the sheet conveying apparatus 10. FIG. 11 illustrates an example in which three sheets consisting of a second sheet 58, a first sheet 56, and another second sheet 58 are conveyed sequentially in the described order, in the same manner as in the example illustrated in FIG. 10.

To begin with, the transmitting unit 66C transmits sheet attribute of the second sheet 58 to the sheet inserting apparatus 36 (Step S300). The sheet attribute of the second sheet 58 may be stored in advance in a memory not illustrated and read from the memory. The receiving unit 66A then receives the sheet interval information being the first time of the second sheet 58 from the sheet inserting apparatus 36 (Step S302).

The transmitting unit 66C then transmits a feeding request of the second sheet 58 to the sheet inserting apparatus 36 (Step S304). The receiving unit 66A then receives the insertion preparation time from the sheet inserting apparatus 36 (Step S306).

The setting unit 66B then sets the time indicated by longer one of the insertion preparation time received at Step S306 and the sheet interval information being the first time of the second sheet 58 received at Step S302, as the insertion interval to insert the second sheet 58 (Step S308).

The conveying controlling unit 67 then adjusts the conveying interval so that the first sheets 56 are conveyed such that an interval extended by an interval corresponding to an added value obtained by adding the conveying time corresponding to the length of the second sheet 58 in the conveying direction to the insertion interval set at Step S302 is provided between the first sheets 56. In this manner, the conveying controlling unit 67 adjusts the dummy conveying timing that is the conveying timing of the virtually conveyed sheet M (Step S309).

The transmitting unit 66C in the system controlling unit 66 then transmits the sheet attribute of the first sheet 56 to the sheet inserting apparatus 36 (Step S310). The sheet attribute of the first sheet 56 may be stored in advance in a memory not illustrated and read from the memory. The receiving unit 66A then receives the sheet interval information of the first sheet 56 from the sheet inserting apparatus 36 (Step S312).

After receiving the sheet interval information of the first sheet 56, the sheet conveying apparatus 10 controls the conveying unit 42 to adjust the conveying timing so that the first sheet 56 starts to be conveyed at the time apart from the virtually conveyed sheet M by a conveying interval (conveying time interval) that is based on the sheet interval information of the first sheet 56 received by the conveying controlling unit 67 (Step S313). In this manner, the first sheet 56 starts being conveyed.

The transmitting unit 66C then transmits the sheet attribute of the second sheet 58 to the sheet inserting apparatus 36 (Step S314). The sheet attribute of the second sheet 58 may be stored in advance in a memory not illustrated and read from the memory. The receiving unit 66A then receives the sheet interval information being the first time of the second sheet 58 from the sheet inserting apparatus 36 (Step S316).

The transmitting unit 66C then transmits a feeding request of the second sheet 58 to the sheet inserting apparatus 36 (Step S318). The receiving unit 66A then receives the insertion preparation time from the sheet inserting apparatus 36 (Step S320).

The setting unit 66B then sets the time indicated by longer one of the insertion preparation time received at Step S320 and the sheet interval information being the first time of the second sheet 58 received at Step S316, as the insertion interval to insert the second sheet 58 (Step S322).

The conveying controlling unit 67 controls the conveying unit 42 so that the first sheets 56 are conveyed such that an interval extended by an interval corresponding to an added value obtained by adding the conveying time corresponding to the length of the second sheet 58 in the conveying direction to the insertion interval set at Step S322 is provided between the first sheets 56. In this manner, the conveying controlling unit 67 adjusts the dummy conveying timing that is the conveying timing of the virtually conveyed sheet M (Step S323).

The system controlling unit 66 then determines if the virtually conveyed sheet M (the second sheet 58) reaches the sheet discharge surface R (Step S324), and repeatedly determines No (No at Step S324) until the system controlling unit 66 determines Yes (Yes at Step S324).

When the system controlling unit 66 determines Yes at Step S324 (Yes at Step S324), the process goes to Step S326. At Step S326, the transmitting unit 66C transmits the insertion request of the second sheet 58 to the sheet inserting apparatus 36 (Step S326).

The system controlling unit 66 then determines if the first sheet 56 reaches the sheet discharge surface R (Step S328), and repeatedly determines No (No at Step S328) until the system controlling unit 66 determines Yes (Yes at Step S328). At Step S328, the system controlling unit 66 makes the determination at Step S328 based on whether the detecting unit 66D receives a detection result indicating that the first sheet 56 is detected from the sensor 90B.

When the system controlling unit 66 determines Yes at Step S328 (Yes at Step S328), the process goes to Step S330. At Step S330, the transmitting unit 66C transmits a sheet discharge ON signal and a sheet discharge OFF signal of the first sheet 56 to the sheet inserting apparatus 36 (Step S330).

The system controlling unit 66 then determines if the virtually conveyed sheet M reaches the insertion request transmitting position U (Step S332), and repeatedly determines No (No at Step S332) until the system controlling unit 66 determines Yes (Yes at Step S332).

The determination at Step S332 can be made by determining if the insertion interval set at Step S322 has elapsed after the most downstream end of the first sheet 56 in the conveying direction is detected by the sensor 90B. When Yes is determined at Step S332 (Yes at Step S332), the process goes to Step S334. At Step S334, the transmitting unit 66C transmits an insertion request of the first sheet 56 to the sheet inserting apparatus 36 (Step S334). This routine is then ended.

The conveying process performed in the sheet inserting apparatus 36 will now be explained.

Figure 12:
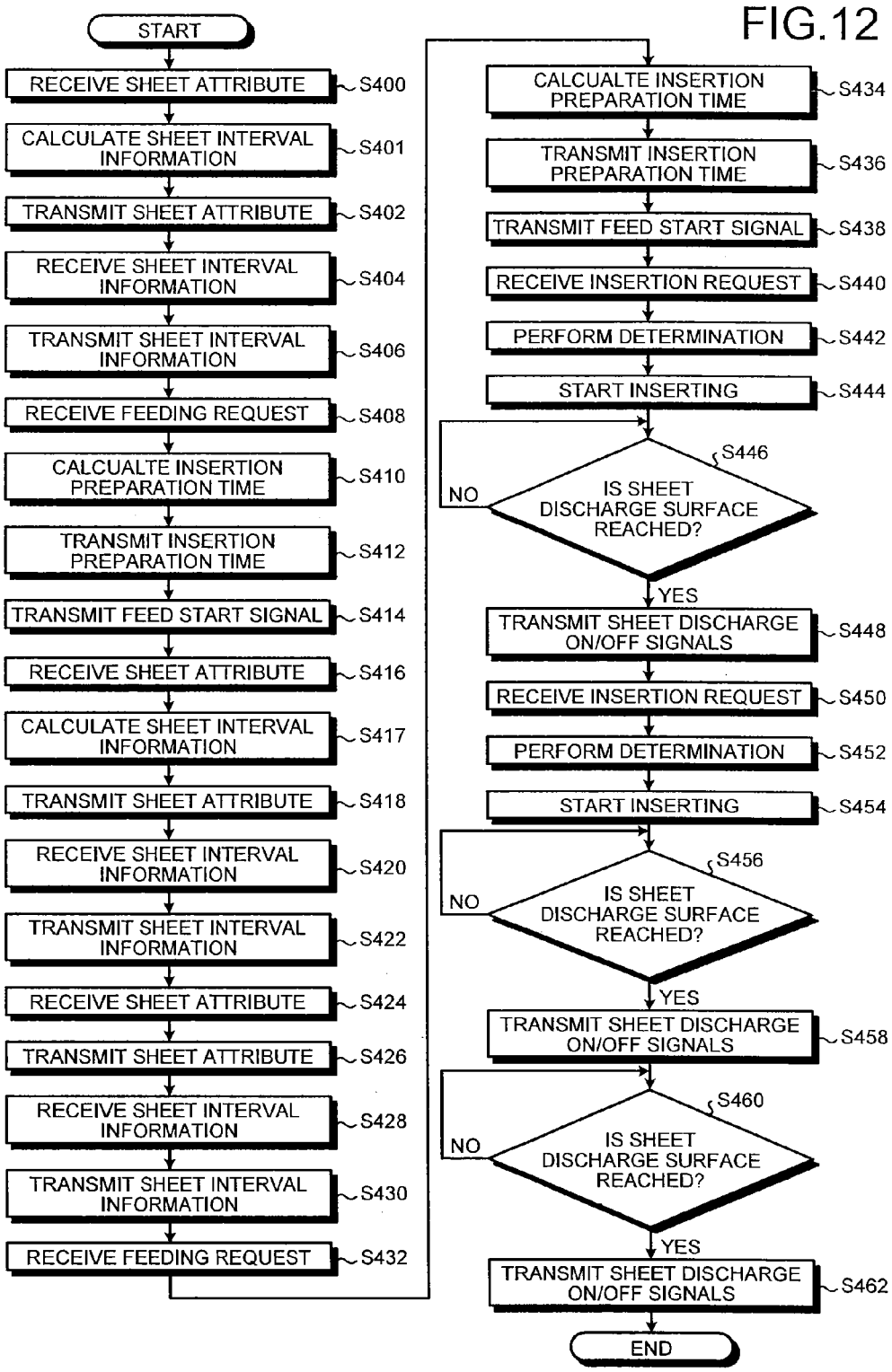
FIG. 12 is a flowchart illustrating another example of the conveying process performed in the sheet inserting apparatus.

FIG. 12 is a flowchart illustrating the conveying process performed in the sheet inserting apparatus 36. FIG. 12 illustrates an example in which three sheets consisting of a second sheet 58, a first sheet 56, and another second sheet 58 are conveyed sequentially in the described order, in the same manner as in the example illustrated in FIG. 10.

To begin with, the receiving unit 70B receives the sheet attribute of the second sheet 58 from the sheet conveying apparatus 10 (Step S400). When the receiving unit 70B receives the sheet attribute of the second sheet 58, the calculating unit 70C calculates sheet interval information of the second sheet 58 (Step S401). The transmitting unit 70A then transmits the sheet attribute of the second sheet 58 to the post-processing apparatus 34 (Step S402).

When the receiving unit 70B receives the sheet interval information of the second sheet 58 from the post-processing apparatus 34 (Step S404), the transmitting unit 70A transmits longer one of the sheet interval information of the second sheet 58 calculated by the calculating unit 70C at Step S401 and the sheet interval information received at Step S404, to the sheet conveying apparatus 10 as the sheet interval information being the first time of the second sheet 58 (Step S406).

The receiving unit 70B then receives the feeding request of the second sheet 58 from the sheet conveying apparatus 10 (Step S408). After receiving the feeding request, the conveying controlling unit 74 starts the conveying process of conveying the second sheet 58 accumulated in the tray 50 from the discharge position S toward the insertion standby position Y along the conveying path B, by controlling the conveying unit 62.

The calculating unit 70C then calculates the insertion preparation time (Step S410). The transmitting unit 70A then transmits the calculated insertion preparation time to the sheet conveying apparatus 10 (Step S412). The transmitting unit 70A then transmits a feed start signal to the sheet conveying apparatus 10 (Step S414).

The receiving unit 70B then receives the sheet attribute of the first sheet 56 from the sheet conveying apparatus 10 (Step S416). When the receiving unit 70B receives the sheet attribute of the first sheet 56, the calculating unit 70C calculates sheet interval information of the first sheet 56 (Step S417).

The transmitting unit 70A then transmits the received sheet attribute of the first sheet 56 to the post-processing apparatus 34 (Step S418).

The receiving unit 70B then receives the sheet interval information of the first sheet 56 from the post-processing apparatus 34 (Step S420). The transmitting unit 70A transmits longer one of the sheet interval information of the first sheet 56 calculated by the calculating unit 70C at Step S417 and the sheet interval information received at Step S420, to the sheet conveying apparatus 10 (Step S422).

The receiving unit 70B then receives the sheet attribute of the second sheet 58 from the sheet conveying apparatus 10 (Step S424). When the receiving unit 70B receives the sheet attribute of the second sheet 58, the calculating unit 70C calculates sheet interval information of the second sheet 58. The transmitting unit 70A then transmits the sheet attribute of the second sheet 58 to the post-processing apparatus 34 (Step S426).

When the receiving unit 70B receives the sheet interval information of the second sheet 58 from the post-processing apparatus 34 (Step S428), the transmitting unit 70A transmits longer one of the sheet interval information of the second sheet 58 calculated by the calculating unit 70C after Step S424 and the sheet interval information received at Step S428, to the sheet conveying apparatus 10 as the sheet interval information being the first time of the second sheet 58 (Step S430).

The receiving unit 70B then receives a feeding request from the sheet conveying apparatus 10 (Step S432). After receiving the feeding request, the conveying controlling unit 74 starts the conveying process of conveying the second sheet 58 accumulated in the tray 50 from the discharge position S toward the insertion standby position Y along the conveying path B, by controlling the conveying unit 62.

The calculating unit 70C then calculates the insertion preparation time (Step S434). The transmitting unit 70A then transmits the calculated insertion preparation time to the sheet conveying apparatus 10 (Step S436). The transmitting unit 70A then transmits a feed start signal to the sheet conveying apparatus 10 (Step S438).

The receiving unit 70B then receives the insertion request of the second sheet 58 (Step S440). The calculating unit 70C then determines a third time which is used so that the second sheet 58 at the insertion standby position Y is merged at the merging point P after the third time elapses after the insertion request is received (Step S442). The third time is determined in a manner similar to that at Step S236.

The conveying controlling unit 74 then starts inserting the second sheet 58 by controlling the conveying unit 62 to start the insertion process (Step S444). At Step S238, more specifically, the conveying controlling unit 74 starts the insertion process of causing the second sheet 58 at the insertion standby position Y to be merged at the merging point P when the third time determined at Step S442 elapses after the insertion request is received at Step S440.

Through the process at Step S444, the second sheet 58 is inserted.

The detecting unit 70D then determines if the first one of the second sheets 58 reaches the sheet discharge surface W (Step S446). The determination at Step S446 is made by determining if a detection signal of the second sheet 58 is received from the sensor 90G.

At Step S446, No is repeatedly determined (No at Step S446) until Yes is determined (Yes at Step S446). When Yes is determined, the process goes to Step S448.

At Step S448, a sheet discharge ON signal and a sheet discharge OFF signal of the second sheet 58 are transmitted to the post-processing apparatus 34 (Step S448). The receiving unit 70B then receives the insertion request of the second sheet 58 (Step S450). The calculating unit 70C then determines the third time which is used so that the second sheet 58 at the insertion standby position Y is merged at the merging point P after the third time elapses after the insertion request is received (Step S452). The third time is determined in a manner similar to that at Step S236.

The conveying controlling unit 74 then starts inserting the second sheet 58 by controlling the conveying unit 62 to start the insertion process (Step S454). At Step S454, more specifically, the conveying controlling unit 74 starts the insertion process of causing the second sheet 58 at the insertion standby position Y to be merged at the merging point P when the third time determined at Step S452 elapses after the insertion request is received at Step S450.

Through the process at Step S454, the second sheet 58 is inserted after the first sheet 56.

If the first sheet 56 reaches the sheet discharge surface W is then determined (Step S456). The determination at Step S456 is made by determining if a detection signal of the first sheet 56 is received from the sensor 90G.

At Step S456, No is repeatedly determined (No at Step S456) until Yes is determined (Yes at Step S456). When Yes is determined at Step S456, the process goes to Step S458. At Step S458, a sheet discharge ON signal and a sheet discharge OFF signal of the first sheet 56 are transmitted to the post-processing apparatus 34 (Step S458).

If the second sheet 58 inserted at Step S454 reaches the sheet discharge surface W is then determined (Step S460). The determination at Step S460 is made by determining if a detection signal of the second sheet 58 is received from the sensor 90G.

At Step S460, No is repeatedly determined (No at Step S460) until Yes is determined (Yes at Step S460). When Yes is determined at Step S460, the process goes to Step S462.

At Step S462, a sheet discharge ON signal and a sheet discharge OFF signal of the second sheet 58 are transmitted to the post-processing apparatus 34 (Step S462), and this routine is ended.

As described above, in the sheet conveying system 1 according to the embodiment, the sheet conveying apparatus 10 receives the sheet interval information being the first time of the second sheet 58 and the insertion preparation time from the post-processing apparatus 30, and sets longer one of the sheet interval information being the first time of the second sheet 58 and the insertion preparation time, as the insertion interval to insert the second sheet 58.

The sheet conveying apparatus 10 then controls the conveying unit 42 so that the first sheets 56 are conveyed such that an interval extended by an interval corresponding to an added value obtained by adding the conveying time corresponding to the length of the second sheet 58 in the conveying direction to the set insertion interval is provided between first sheets 56. In this manner, the first sheets 56 are conveyed such that an interval obtained by adding an interval according to the sheet interval information of the first sheet 56 to the interval corresponding to the added value is provided between the first sheets 56 at a position where the second sheet 58 is to be inserted.

In the manner described above, the sheet conveying apparatus 10 conveys the first sheets 56 such that an interval is provided between the first sheets 56 at a position where the second sheet 58 is to be inserted, based on the first time and the insertion preparation time received from the sheet inserting apparatus 36. Therefore, in the sheet conveying system 1, even when the configuration of the sheet inserting apparatus 36 is changed, the computer program of the sheet conveying apparatus 10 does not need to be changed.

Therefore, in the sheet conveying system 1 according to the embodiment, the sheet conveying system 1 that is versatile can be provided.

As explained with reference to FIG. 5, the insertion preparation time (the second time) indicates a time for conveying the second sheet 58 from the discharge position S from the tray 50, where the second sheets 58 are accumulated, to the merging point P (see the time T1 in FIG. 5). The insertion preparation time corresponds to the conveying time from the position of the virtually conveyed sheet M that passes through the photosensitive element 38A next (upstream end of the virtually conveyed sheet in the conveying direction), to the sheet discharge surface R (see the time T8 in FIG. 5).

In the sheet inserting apparatus 36, the second sheet 58 at the insertion standby position Y is merged at the merging point P when the third time elapses after an insertion request is received from the sheet conveying apparatus 10.

As illustrated in FIG. 5, the sheet inserting apparatus 36 adds the sheet discharge surface R to the time for conveying the virtually conveyed sheet M (the second sheet 58) from the sheet receiving surface Q to the merging point P (time T4) to the insertion waiting time (time T5) being the conveying time from the insertion request transmitting position, subtracts the time for conveying the second sheet 58 from the insertion standby position Y to the merging point P (time T3) from the result of the addition, and fixes the result (time T5+time T4−time T3) as the third time.

As illustrated in FIG. 5, the sheet inserting apparatus 36 may fix the result of subtracting the time for conveying the second sheet 58 from the insertion standby position Y to the merging point P (time T3) from the sum of the time for conveying the virtually conveyed sheet M (the second sheet 58) from the sheet receiving surface Q to the merging point P (time T4) and the time for conveying the virtually conveyed sheet M (the second sheet 58) from the insertion request transmitting position U to the sheet discharge surface R (time T5) (time T4+time T5−time T3), as the third time.

In this manner, the sheet inserting apparatus 36 in the sheet conveying system 1 according to the embodiment starts the operation of inserting the second sheet 58 considering the length of the conveying path from the sheet receiving surface Q to the merging point P and the length of conveying path from the insertion standby position Y to the merging point P. Therefore, these conveying path lengths no longer need to be considered in the sheet conveying apparatus 10. Hence, the computer program executing the conveying process does not need to be changed depending on the configuration of the sheet inserting apparatus 36. As a result, the sheet conveying system 1 that is versatile can be provided.

Furthermore, the sheet interval information being the first time of the second sheet 58 required in the sheet inserting apparatus 36 is calculated by the sheet inserting apparatus 36 and transmitted to the sheet conveying apparatus 10. Therefore, the sheet conveying apparatus 10 does not need to calculate the sheet interval information being the first time of the second sheet 58 based on the sheet attribute of the second sheet 58 inserted by the sheet inserting apparatus 36, and can use longer one of the first time and the insertion preparation time, as the sheet interval information being the first time of the second sheet 58. Therefore, the sheet interval control of the sheet conveying apparatus 10 can be simplified.

Furthermore, when a first sheet 56 is conveyed subsequent to a second sheet 58, the sheet conveying apparatus 10 can start the operation of conveying the next first sheet 56 before the second sheet 58 is conveyed into the conveying path B from the tray 50 and reaches the insertion standby position Y. Therefore, reduced productivity of the conveying process caused by inserting a sheet can be prevented.

The sheet conveying program to execute the conveying process performed in the sheet conveying system 1 according to the embodiment is provided in a manner incorporated in the ROM or the like in advance. The sheet conveying program to execute the conveying process performed in the sheet conveying system 1 according to the embodiment may also be configured to be provided in a manner recorded in a computer-readable recording medium such as a compact-disk read-only memory (CD-ROM), a flexible disk (FD), a compact disk recordable (CD-R), or a digital versatile disk (DVD), as a file in an installable or an executable format.

Furthermore, the sheet conveying program to execute the conveying process performed in the sheet conveying system 1 according to the embodiment may be configured to be provided in a manner stored on a computer connected to a network such as the Internet, and made available by downloading over the network. Furthermore, the sheet conveying program to execute the conveying process performed in the sheet conveying system 1 according to the embodiment may be provided or distributed over a network such as the Internet.

The sheet conveying program to execute the conveying process performed in the sheet conveying system 1 according to the embodiment has a modular structure including each of the units described above. In the actual hardware, by causing a CPU (processor) to read the computer program from the ROM and to execute the computer program, each of the modules is loaded onto the main memory, and generated on the main memory.

An embodiment of the present invention can provide a versatile sheet conveying system.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying system comprising:

a sheet conveying apparatus that sequentially conveys a plurality of first recording media; and a sheet inserting apparatus that is provided downstream of the sheet conveying apparatus in a conveying direction of first recording media, and inserts a second recording medium between first recording media, wherein the sheet inserting apparatus comprises:

a first transmitting unit that transmits, to the sheet conveying apparatus, a first time indicating a receiving interval at which second recording media can be successively received from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point, and the sheet conveying apparatus comprises:

a first conveying unit that conveys first recording media at a first interval;

a first receiving unit that receives the first time and the second time;

a setting unit that sets longer one of the first time and the second time as an insertion interval to insert a second recording medium; and a first conveying controlling unit that controls the first conveying unit to convey first recording media such that an interval extended by a second interval corresponding to an added value obtained by adding a conveying time corresponding to a length of the second recording medium in the conveying direction at a first speed to the insertion interval is provided between the first recording media.

2. The sheet conveying system according to claim 1, wherein the sheet conveying apparatus further comprises a first transmitting unit that transmits an insertion instruction of a second recording medium to the sheet inserting apparatus when a virtual sheet position being a position spaced downstream in the conveying direction from a downstream end of a first recording medium in the conveying direction by the insertion interval reaches a discharge surface of first recording media in the sheet conveying apparatus.

3. The sheet conveying system according to claim 2, wherein the sheet inserting apparatus further comprises:

a second conveying unit that conveys a second recording medium from the accumulating unit to the merging point;

a second receiving unit that receives the insertion instruction; and a second conveying controlling unit that controls the second conveying unit to convey a second recording medium from an insertion standby position upstream of the merging point in a conveying direction of a second recording medium to the merging point when a third time set in advance elapses after the insertion instruction is received.

4. The sheet conveying system according to claim 3, wherein the sheet inserting apparatus further comprises a third conveying unit that conveys a first recording medium from a receiving surface of first recording media in the sheet inserting apparatus to the merging point, and the third time is a difference between a first conveying time for conveying a second recording medium from the receiving surface to the merging point and a second conveying time for conveying a second recording medium from the insertion standby position to the merging point.

5. The sheet conveying system according to claim 3, wherein the sheet inserting apparatus further comprises a third conveying unit that conveys a first recording medium from the receiving surface of first recording media in the sheet inserting apparatus to the merging point, the insertion instruction includes a fourth time that is a time from when the insertion instruction is transmitted to when the virtual sheet position reaches the discharge surface, and the third time is a difference between a sum of a first conveying time for conveying a second recording medium from the receiving surface to the merging point and the fourth time, and a second conveying time for conveying a second recording medium from the insertion standby position to the merging point.

6. The sheet conveying system according to claim 1, wherein the sheet inserting apparatus further comprises a calculating unit that calculates the first time based on attribute information of a second recording medium.

7. A computer program product comprising a non-transitory computer-usable medium having computer-readable program codes embodied in the medium, wherein the computer-readable program codes is of a sheet conveying program to be executed by a computer controlling a sheet conveying apparatus that is provided upstream of a sheet inserting apparatus in a conveying direction and sequentially conveys a plurality of first recording media, the sheet inserting apparatus inserting a second recording medium between first recording media, and the program codes when executed causes the computer to execute:

first receiving a first time indicating a receiving interval at which second recording media can be successively received from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point;

setting longer one of the first time and the second time as an insertion interval to insert a second recording medium; and performing first conveying control to convey first recording media such that an interval extended by a second interval corresponding to an added value obtained by adding a conveying time corresponding to a length of the second recording medium in the conveying direction at a first speed to the insertion interval is provided between the first recording media.

8. A sheet conveying method executed by a sheet conveying apparatus that is provided upstream of a sheet inserting apparatus in a conveying direction and sequentially conveys a plurality of first recording media, the sheet inserting apparatus inserting a second recording medium between first recording media, the sheet conveying method comprising:

first receiving a first time indicating a receiving interval at which second recording media can be successively received from the sheet conveying apparatus, and a second time indicating a difference between a conveying time from an accumulating unit in which a second recording medium is accumulated to a merging point at which a second recording medium is inserted between first recording media and a conveying time from a sheet receiving surface of the sheet inserting apparatus to the merging point;

setting longer one of the first time and the second time as an insertion interval to insert the second recording medium; and performing first conveying control to convey first recording media such that an interval extended by a second interval corresponding to an added value obtained by adding a conveying time corresponding to a length of the second recording medium in the conveying direction at a first speed to the insertion interval is provided between the first recording media.

* * * * *